US011708830B2

(12) United States Patent
Nowell et al.

(10) Patent No.: US 11,708,830 B2
(45) Date of Patent: Jul. 25, 2023

(54) MULTI-PIECE FLUID END

(71) Applicant: Kerr Machine Co., Sulphur, OK (US)

(72) Inventors: Mark S. Nowell, Ardmore, OK (US); Kelcy Jake Foster, Ardmore, OK (US)

(73) Assignee: Kerr Machine Co., Sulphur, OK (US)

( * ) Notice: Subject to any disclaimer, the term of this patent is extended or adjusted under 35 U.S.C. 154(b) by 344 days.

(21) Appl. No.: 16/216,685

(22) Filed: Dec. 11, 2018

(65) Prior Publication Data

US 2019/0178243 A1 Jun. 13, 2019

Related U.S. Application Data

(60) Provisional application No. 62/646,970, filed on Mar. 23, 2018, provisional application No. 62/597,241, filed on Dec. 11, 2017.

(51) Int. Cl.

| | |
|---|---|
| ***F04B 53/16*** | (2006.01) |
| ***F04B 53/22*** | (2006.01) |
| ***F04B 53/00*** | (2006.01) |
| ***F04B 1/0404*** | (2020.01) |
| ***F04B 1/053*** | (2020.01) |
| ***F04B 1/0538*** | (2020.01) |

(52) U.S. Cl.

CPC ..... *F04B 53/16* (2013.01); *F04B 1/0404* (2013.01); *F04B 1/053* (2013.01); *F04B 1/0538* (2013.01); *F04B 53/007* (2013.01); *F04B 53/22* (2013.01); *F05B 2210/11* (2013.01); *F05B 2250/12* (2013.01)

(58) Field of Classification Search

CPC ..... F04B 53/16; F04B 1/0404; F04B 53/22; F04B 1/053; F04B 1/0538; F04B 53/007; F05B 2250/12; F05B 2210/11

USPC ..... 417/360; 92/129

See application file for complete search history.

(56) References Cited

U.S. PATENT DOCUMENTS

| | | | |
|---|---|---|---|
| 589,725 | A | 9/1897 | Hodge et al. |
| 1,316,539 | A | 6/1919 | Ford |
| 1,822,682 | A | 9/1931 | Weiger |
| 1,867,279 | A | 7/1932 | Price |
| 1,995,395 | A | 3/1935 | Mohr |
| 2,713,522 | A | 7/1955 | Fetch |

(Continued)

OTHER PUBLICATIONS

Exhibits A-D include photos of a power end and fluid end known in the art prior to Dec. 11, 2017, 4 pages.

(Continued)

*Primary Examiner* — Philip E Stimpert
*Assistant Examiner* — Dnyanesh G Kasture
(74) *Attorney, Agent, or Firm* — Tomlinson McKinstry, P.C.

(57) ABSTRACT

A multi-piece fluid end that can be produced with fewer raw materials and at a lower cost. In one embodiment, a fluid end is formed from a first body attached to a separate second body. Their respective external surfaces may be engaged flushly, partially, or via one or more spacer elements. In some embodiments, the body pieces are flangeless to reduce stress on the fluid end. The second body may have a plurality of bores that are alignable with a plurality of corresponding bores formed in the first body. The second body may be connected to a power end using a plurality of stay rods. In other implementations, more than two body pieces may be utilized.

52 Claims, 15 Drawing Sheets

(56) References Cited

U.S. PATENT DOCUMENTS 2,756,960 A 7/1956 Church
2,856,857 A 10/1958 Saalfrank
3,053,500 A 9/1962 Atkinson
3,146,724 A 9/1964 Cornelsen
3,152,787 A 10/1964 Timmons
3,173,648 A 3/1965 McGuire et al.
3,179,121 A 4/1965 Bredtschneider et al.
3,219,311 A 11/1965 Siver
3,244,424 A 4/1966 Cope
3,257,095 A 6/1966 Siver
3,257,952 A 6/1966 McCormick
3,269,698 A 8/1966 Koch
3,373,695 A * 3/1968 Yohpe ..... F04B 53/1025 417/569
3,427,988 A * 2/1969 Schmieman ..... F04B 53/10 417/569
3,474,808 A 10/1969 Elliott
3,504,888 A 4/1970 Bates, Jr. et al.
3,589,387 A 6/1971 Raymond
3,679,332 A 7/1972 Yohpe
3,698,726 A 10/1972 Schertler
3,702,624 A 11/1972 Fries
3,831,900 A 8/1974 Matousek et al.
4,047,850 A 9/1977 Berthelot
4,077,102 A 3/1978 Smith
4,170,214 A 10/1979 Gill et al.
4,363,463 A 12/1982 Moon, Jr.
4,388,050 A 6/1983 Schuller
4,467,703 A 8/1984 Redwine et al.
4,470,771 A 9/1984 Hall et al.
4,520,837 A 6/1985 Cole et al.
4,768,933 A 9/1988 Stachowiak
4,771,801 A * 9/1988 Crump ..... F04B 49/121 137/68.26
4,773,833 A 9/1988 Wilkinson et al.
4,778,347 A 10/1988 Mize
4,861,241 A * 8/1989 Gamboa ..... F04B 53/1027 417/454
4,878,815 A * 11/1989 Stachowiak ..... F04B 53/1025 417/63
4,948,349 A 8/1990 Koiwa
1,981,970 A 1/1991 Eickmann
4,984,970 A 1/1991 Eickmann
5,059,101 A * 10/1991 Valavaara ..... F04B 53/109 417/569
5,073,096 A 12/1991 King et al.
5,145,340 A 9/1992 Allard
5,207,242 A 5/1993 Daghe et al.
5,226,445 A 7/1993 Surjaatmadja
5,362,215 A 11/1994 King
5,370,148 A 12/1994 Shafer
5,507,219 A 4/1996 Stogner
5,524,902 A 6/1996 Cornette
5,626,345 A 5/1997 Wallace
D383,053 S 9/1997 Schrader et al.
5,685,519 A 11/1997 Bircann et al.
6,000,764 A 12/1999 Dokas
6,164,318 A 12/2000 Dixon
6,167,959 B1 1/2001 Bassinger et al.
6,257,626 B1 10/2001 Campau et al.
6,382,940 B1 5/2002 Blume
6,419,459 B1 * 7/2002 Sibbing ..... F04B 53/162 29/888.044
6,544,012 B1 4/2003 Blume
6,641,112 B2 11/2003 Antoff et al.
6,910,871 B1 6/2005 Blume
7,140,211 B2 11/2006 Tremblay
7,168,440 B1 1/2007 Blume
7,186,097 B1 3/2007 Blume
7,290,560 B2 11/2007 Orr et al.
7,296,591 B2 * 11/2007 Moe ..... F04B 53/109 137/512
7,335,002 B2 6/2008 Vicars
7,506,574 B2 3/2009 Jensen et al.
7,513,759 B1 4/2009 Blume
D616,966 S 6/2010 Angell
7,789,133 B2 9/2010 McGuire
7,828,053 B2 11/2010 McGuire et al.
7,845,413 B2 12/2010 Shampine et al.
D631,142 S 1/2011 Angell
7,866,346 B1 1/2011 Walters
7,891,374 B2 2/2011 Vicars
7,963,502 B2 6/2011 Lovell et al.
8,100,407 B2 * 1/2012 Stanton ..... F16J 15/183 277/511
8,317,498 B2 11/2012 Gambier et al.
8,360,094 B2 1/2013 Steinbock et al.
8,365,754 B2 2/2013 Riley et al.
8,528,462 B2 9/2013 Pacht
8,528,585 B2 9/2013 McGuire
8,701,546 B2 4/2014 Pacht
D731,035 S 2/2015 Lo Cicero
9,010,412 B2 4/2015 McGuire
D737,497 S 8/2015 Burgess et al.
9,188,121 B1 11/2015 Dille
D748,228 S 1/2016 Bayyouk et al.
9,260,933 B2 2/2016 Artherholt et al.
9,328,745 B2 5/2016 Bartlok et al.
9,371,919 B2 * 6/2016 Forrest ..... F16K 43/00
9,416,887 B2 8/2016 Blume
9,435,454 B2 9/2016 Blume
9,534,473 B2 1/2017 Morris et al.
9,631,739 B2 4/2017 Belshan et al.
D787,029 S 5/2017 Bayyouk et al.
9,732,746 B2 8/2017 Chandrasekaran et al.
9,822,894 B2 11/2017 Bayyouk et al.
D806,241 S 12/2017 Swinney et al.
10,184,470 B2 1/2019 Barnett, Jr.
10,221,847 B2 3/2019 Dyer
10,519,950 B2 12/2019 Foster
10,914,171 B2 2/2021 Foster
2002/0166588 A1 11/2002 Dean
2004/0170507 A1 9/2004 Vicars
2004/0234404 A1 11/2004 Vicars
2005/0151107 A1 7/2005 Shu
2005/0200081 A1 9/2005 Stanton et al.
2006/0002806 A1 * 1/2006 Baxter ..... F04B 39/10 417/539
2006/0027779 A1 2/2006 McGuuire et al.
2006/0165541 A1 * 7/2006 Teshima ..... F04B 43/10 417/472
2008/0006089 A1 1/2008 Adnan et al.
2008/0008605 A1 1/2008 Bauer et al.
2008/0093361 A1 4/2008 Kennedy et al.
2008/0279706 A1 11/2008 Gambier et al.
2010/0243255 A1 9/2010 Luharuka et al.
2011/0079302 A1 4/2011 Hawes
2011/0189040 A1 4/2011 Vicars
2011/0173814 A1 7/2011 Patel
2011/0206547 A1 8/2011 Kim et al.
2011/0236238 A1 9/2011 Cordes et al.
2012/0063936 A1 3/2012 Baxter et al.
2012/0141308 A1 6/2012 Saini et al.
2012/0187321 A1 7/2012 Small
2013/0020521 A1 1/2013 Byrne
2013/0112074 A1 5/2013 Small
2013/0202458 A1 8/2013 Byrne et al.
2013/0319220 A1 * 12/2013 Luharuka ..... F04B 39/12 92/165 R
2014/0127062 A1 5/2014 Buckley et al.
2014/0196883 A1 7/2014 Artherholt et al.
2014/0348677 A1 11/2014 Moeller et al.
2015/0084335 A1 3/2015 Farrell et al.
2015/0132157 A1 5/2015 Whaley et al.
2015/0144826 A1 5/2015 Bayyouk et al.
2016/0123313 A1 5/2016 Simmons
2016/0160848 A1 6/2016 Toppings et al.
2017/0002947 A1 1/2017 Bayyouk et al.
2017/0089473 A1 3/2017 Nowell et al.
2017/0204852 A1 7/2017 Barnett
2017/0211565 A1 * 7/2017 Morreale ..... F04B 39/14
2018/0017173 A1 1/2018 Nowell et al.

(56) References Cited

U.S. PATENT DOCUMENTS

| | | | | |
|---|---|---|---|---|
| 2018/0313456 | A1 | 11/2018 | Bayyouk et al. | |
| 2019/0011051 | A1 | 1/2019 | Yeung | |
| 2019/0128104 | A1* | 5/2019 | Graham | E21B 43/267 |

OTHER PUBLICATIONS

Exhibit "A" includes cross-sectional views of fluid end assemblies known in the art prior to Dec. 11, 2017. 4 pages.
Exhibit "B" includes side views of valve seats known in the art prior to Dec. 11, 2017. 2 pages.
Exhibit "C" is a cross-sectional view of a plunger end of a fluid assembly known in the art prior to Dec. 11, 2017. 1 page.
Exhibit "D" includes an engineering drawing and pictures of a mud pump known in the art prior to Dec. 11, 2017. 4 pages.
National Oilwell Varco 267Q-6M Quintuplex Plunger Pump Parts List, issued Sep. 6, 2000 and revised Jul. 21, 2008 (NOV-267Q), 13 pages.
Gradner Denver, Well Servicing Pump, Model GD-3000 Operating and Service Manual, dated Apr. 2011, (GD-3000), 44 pages.
U.S. Patent and Trademark Office File History for U.S. Pat. No. 10,591,070, 168 pages, Alexandria, VA—See USPTO Records.
Exhibit D (Part 1)—Declaration of William D. Marscher, PE, 209 pages.
Exhibit D (Part 2)—Declaration of William D. Marscher, PE, 124 pages.
Exhibit E—U.S. Patent and Trademark Office File History for U.S. Appl. No. 62/234,483, 45 pages, Alexandria, VA.
Exhibit F—U.S. Patent and Trademark Office File History for U.S. Appl. No. 62/315,343, 41 pages, Alexandria, VA.
Exhibit G—U.S. Patent and Trademark Office File History for U.S. Appl. No. 62/318,542, 44 pages, Alexandria, VA.
Exhibit H—U.S. Patent and Trademark Office File History for U.S. Appl. No. 62/346,915, 41 pages, Alexandria, VA.
U.S. Patent and Trademark Office File History for U.S. Pat. No. 10,591,070, 353 pages, Alexandria, VA—See USPTO Records.
U.S. Patent and Trademark Office File History for U.S. Appl. No. 15/719,124, 183 pages, Alexandria, VA—See USPTO Records.
Exhibit K—Susan Woods, Groove Milling, Cutting Tool Engineering, published Aug. 1, 2012, 11 pages.
Exhibit L—"Weir SPM General Catalog" (2009), 40 pages.
Exhibit M—Groovex, "Groove Milling, High Precision Tools for Groove Milling" brochure, Edition 04, dated Dec. 2012, 24 pages.
Exhibit N—Ricky Smith & R. Keith Mobley, Rules of Thumb for Maintenance and Reliability Engineers, 239-250 (2008), 15 pages.
EXHIBIT O—Ross Mackay, "Process engineering: Properly seal that pump", Chemical Processing, dated May 17, 2005, 11 pages.
Exhibit P—Vargus Ltd., "Groovex Groove milling", YOUTUBE (Dec. 12, 2011, https://www.youtube.com/watch?v=vrFzHJUXjvk, 68 pages.
Exhibit Q—Paresh Girdhar, Octo Moniz, & Steve Mackay, Centrifugal Pump Design, "Plant and Process Engineering 360°", 521-536 (2004), 21 pages.
Exhibit R—Paresh Girdhar, Octo Moniz, & Steve Mackay, Centrifugal Pump Design and Construction, Practical "Centrifugal Pumps: Design, Operation and Maintenance", 18-47 (2005), 33 pages.
Exhibit S—Gardner Denver, "Well Servicing Pump", Model HD-2250 Operating and Service Manual, dated Jan. 2005, 44 pages.
Exhibit T—Robert Crosier, "Flush Free Sealing Benefits", Empowering Pumps & Equipment, dated Oct. 3, 2011, 5 pages.
Exhibit U—Cat "Quintuplex Well Stimulation Pump", WS255 (2013), 2 pages.
Exhibit V—Oxford "Dictionary of Mechanical Engineering", excerpted (2013), 10 pages.
Exhibit W—United States Patent and Trademark Office, Before the Patent Trial and Appeal Board, "*Cizion, LLC d/b/a Vulcan Industrial Manufacturing*, Petitioner v. *Kerr Maching Co.*, Patent Owner " Case PGR2020-00065 U.S. Pat. No. 10,591,070, Petition for Post-Grant Review of U.S. Pat. No. 10,591,070 Under 35 U.S.C. Section 321-329 and 37 C.F.R. Section 42.200 Et Seq.—197 pages.
International Search Authority "PCT International Search Report", dated Mar. 31, 2020, 3 pages, Korean Intellectual Property Office, Republic of Korea.
Wikipedia, Washer (hardware), 2017, first page; 10 pages.

* cited by examiner

MULTI-PIECE FLUID END

BACKGROUND

Fluid ends are used in oil and gas operations to deliver highly pressurized corrosive and/or abrasive fluids to piping leading to a wellbore. Fluid is pumped throughout a fluid end by a plurality of plungers disposed within bores formed in the fluid end body. An engine attached to a power end causes the plungers to reciprocate within the bores. The power end is attached to the fluid end via a plurality of stay rods. Stay rods are known in the art as elongate steel rods.

Fluid used in high-pressure hydraulic fracturing operations is typically pumped through the fluid end at a minimum of 5,000 to 8,000 psi; however, fluid will normally be pumped through the fluid end at pressures around 10,000-15,000 psi during such operations.

The corrosive and/or abrasive fluid pumping through a fluid end at high flow rates and pressures causes the fluid end to wear faster than a power end. Thus, a fluid end typically has a much shorter lifespan than a power end. A typical power end may service five or more different fluid ends during its lifespan. The stay rods used to attach the fluid ends to power ends may be reused with each new fluid end.

In fluid ends known in the art, such as the fluid end 300 shown in FIGS. 14 and 15, a flange is machined into a fluid end body to provide a connection point for a plurality of stay rods. A flange 302 is shown formed in a fluid end body 304 in FIGS. 14 and 15. A plurality of stay rods 306 interconnect a power end 308 and the flange 302.

DETAILED DESCRIPTION

Figure 14:
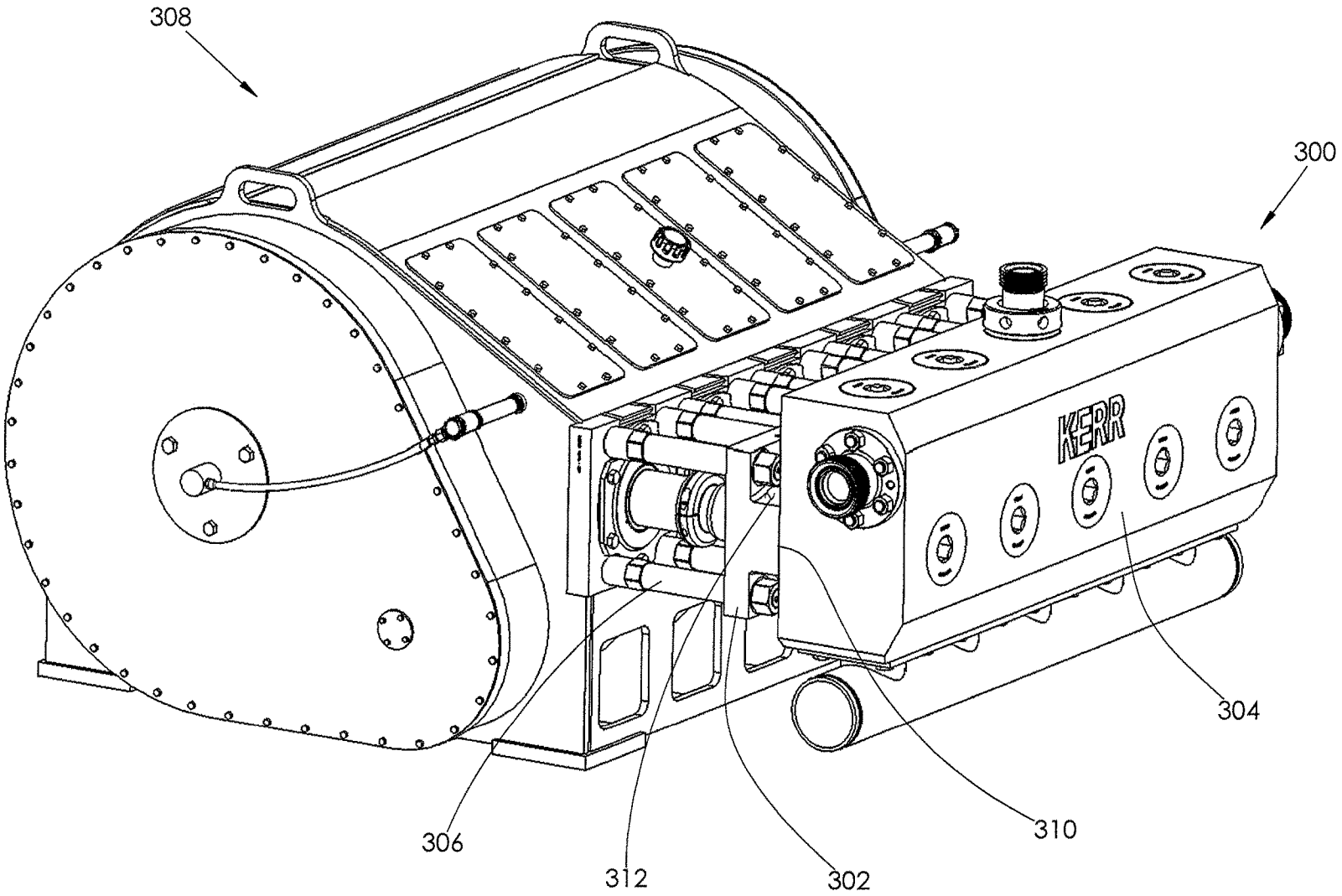
PRIOR ART FIG. 14
FIG. 14 is a perspective view of a fluid end known in the art attached to a power end.
Figure 15:
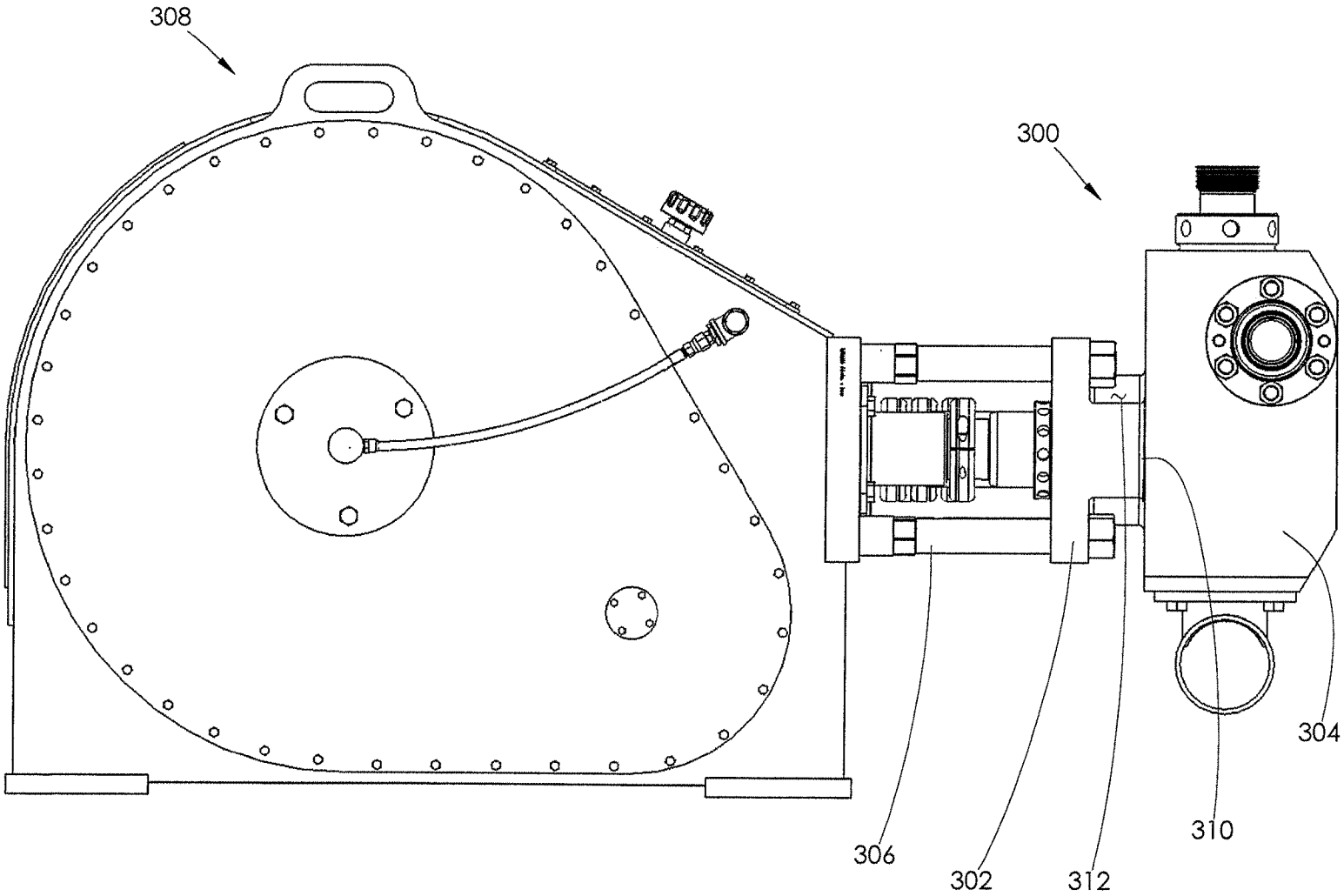
PRIOR ART FIG. 15
FIG. 15 is a side elevation view of the fluid end and power end shown in FIG. 14.

The inventors have recognized that current fluid end designs including those shown in FIGS. 14 and 15 are problematic for several reasons. First, for those designs having a flange, the machining required to create a flange reduces the strength of the fluid end by producing stress concentrations that reduce the effective life of the fluid end. Second, machining the flange into the fluid end also entails wastage of significant amounts of removed raw material, and requires a significant investment of time and labor, thus resulting in increased manufacturing costs.

One solution to the issues presented by a machined flange is to remove the flange and attach the stay rods directly to the fluid end body. However, this solution requires uniquely designed stay rods that must be replaced with the fluid end each time the fluid end reaches the end of its lifespan. Such an approach may thus be disadvantageous during actual operation of the device.

To address these problems, the inventors have designed a multi-body-piece fluid end, embodiments of which are shown in FIGS. 1-13. Such designs, particularly those that are flangeless, may lead to less stress being placed on the fluid end during operation, resulting in increased product life. This design also uses fewer raw materials, reducing manufacturing costs. Still further, the construction of the fluid end permits it to be attached to a power end using traditional stay rods.

In general, fluid ends with multiple body pieces are contemplated by the present disclosure. Thus, the fluid end body is not formed from a monolithic piece of material as in certain prior art designs. As will be described below, FIGS. 1-2, for example, illustrate a fluid end with two body pieces, 20 and 22; this design achieves savings in raw materials (and thus cost), and also leads to less stress on the fluid end during operation, in part because of the flangeless design. That is, neither of body pieces 20 or 22 includes a flange, such as flange 302 shown in FIGS. 14-15. As used herein, a "flange" is used according to its ordinary meaning in the art, and includes a piece of a structural member that has a wider portion as compared to another portion of the structural member, such as a rim, rib, collar, plate, ring, etc. In FIGS. 14-15, for example, the flanged member has the shape of a half I-beam, or alternately a sideways "T"-shape. As used herein, a "flangeless" fluid end body piece is one that does not include a flange.

In embodiments with two body pieces, the second body piece, upon installation, is closer to the power end than the first body piece. In such an arrangement, a front side of the second body piece may engage with a back side of the front body piece in various manners. In certain embodiments, the first and second body pieces may be in flush engagement, meaning that the entire surface of the front side of the second body piece (excluding bores and through holes since these areas have no surface) is in contact with the back side of the first body piece. The concept of flush engagement thus includes embodiments in which the front side of the second body piece and the back side of the first body piece have the same surface dimensions, as well as embodiments in which the back side of the front body piece has at least one surface dimension that is larger than a corresponding surface dimension of the front side of the second body piece. In the former scenario, the front side of the second body piece may be said to align with and abut the back side of the first body piece. In other embodiments, the front side of the second body piece might have one or more beveled edges, such that it has slightly smaller dimensions than the back side of the first body piece. Flush engagement between the front side of the second body piece and the back side of the first body piece includes embodiments in which the engaging portions of the two surfaces are planar, as well as embodiments in which the surfaces are not planar. Alternately, the front side of the second body piece may be partially engaged with the back side of the second body piece, meaning that not every portion of the front side of the second body piece contacts a portion of the back side of the first body piece. Note that partial engagement between the two body pieces may exist both when the two pieces have the same surface dimensions (for example, certain portions of one or both of the pieces may project such that only those portions contact the other piece), as well as when the second body piece has at least one surface dimension that is greater than a corresponding surface dimension of the first body piece.

The present disclosure also contemplates fluid ends with more than two body pieces. For instance, the front side of the second body piece may engage with the back side of the first body piece via one or more spacer elements. For example, washers might be used to separate the first and second body pieces at a distance. In other embodiments, the spacer element may be a thin intervening body piece configured to be situated between the first and second body pieces. The portion of the fluid end nearest the power end upon installation can also be composed of multiple individual pieces ("a plurality of second fluid end body pieces"), each of which has a front side that can engage with the back side of the first body in one of the various manners described above. Whether the portion of the fluid end nearest the power end is composed of a single piece or two or more sub-pieces, this portion being flangeless may advantageously reduce internal stress on the fluid end and extend its life.

Figure 1:
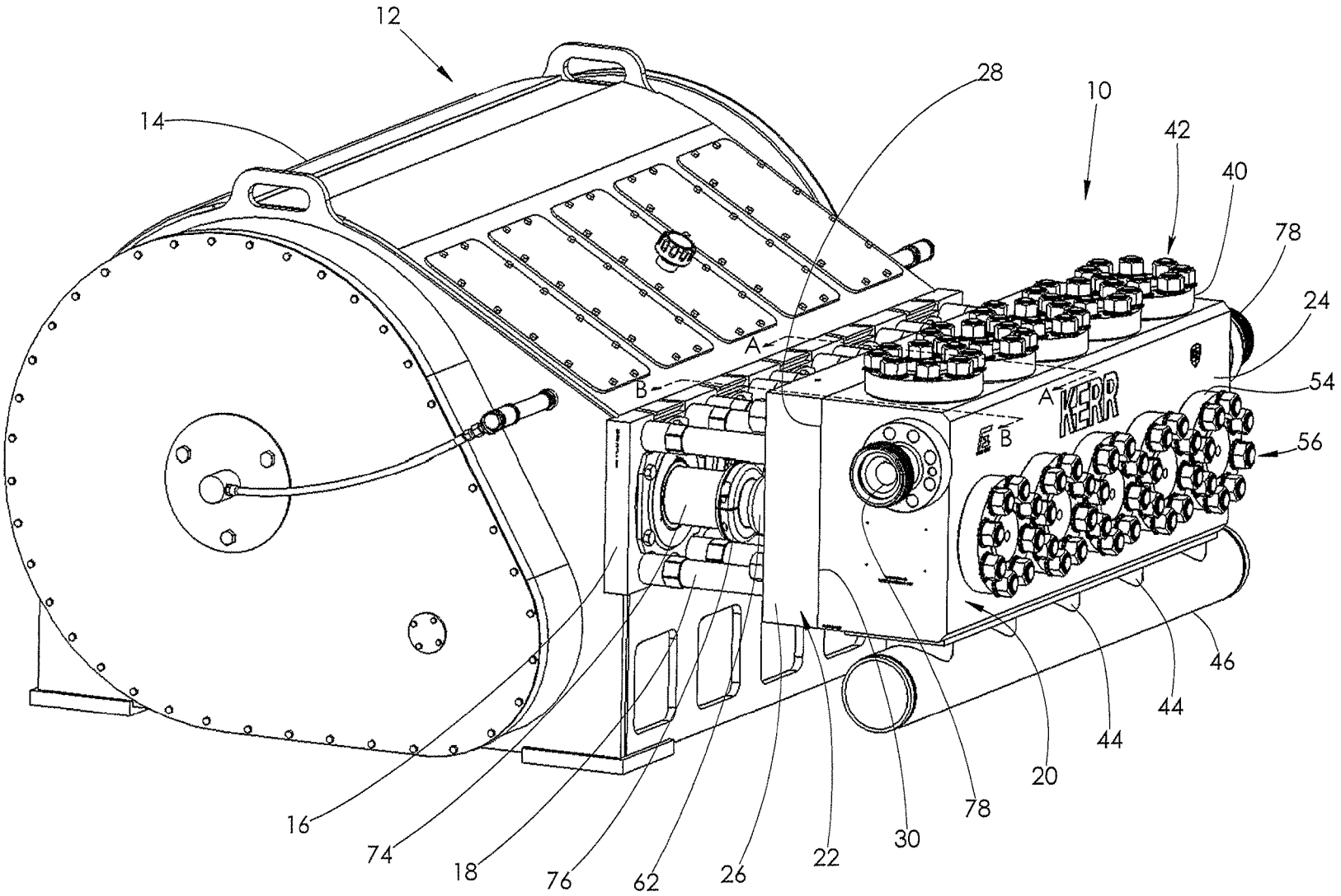
FIG. 1 is a perspective view of a fluid end attached to a power end.
Figure 2:
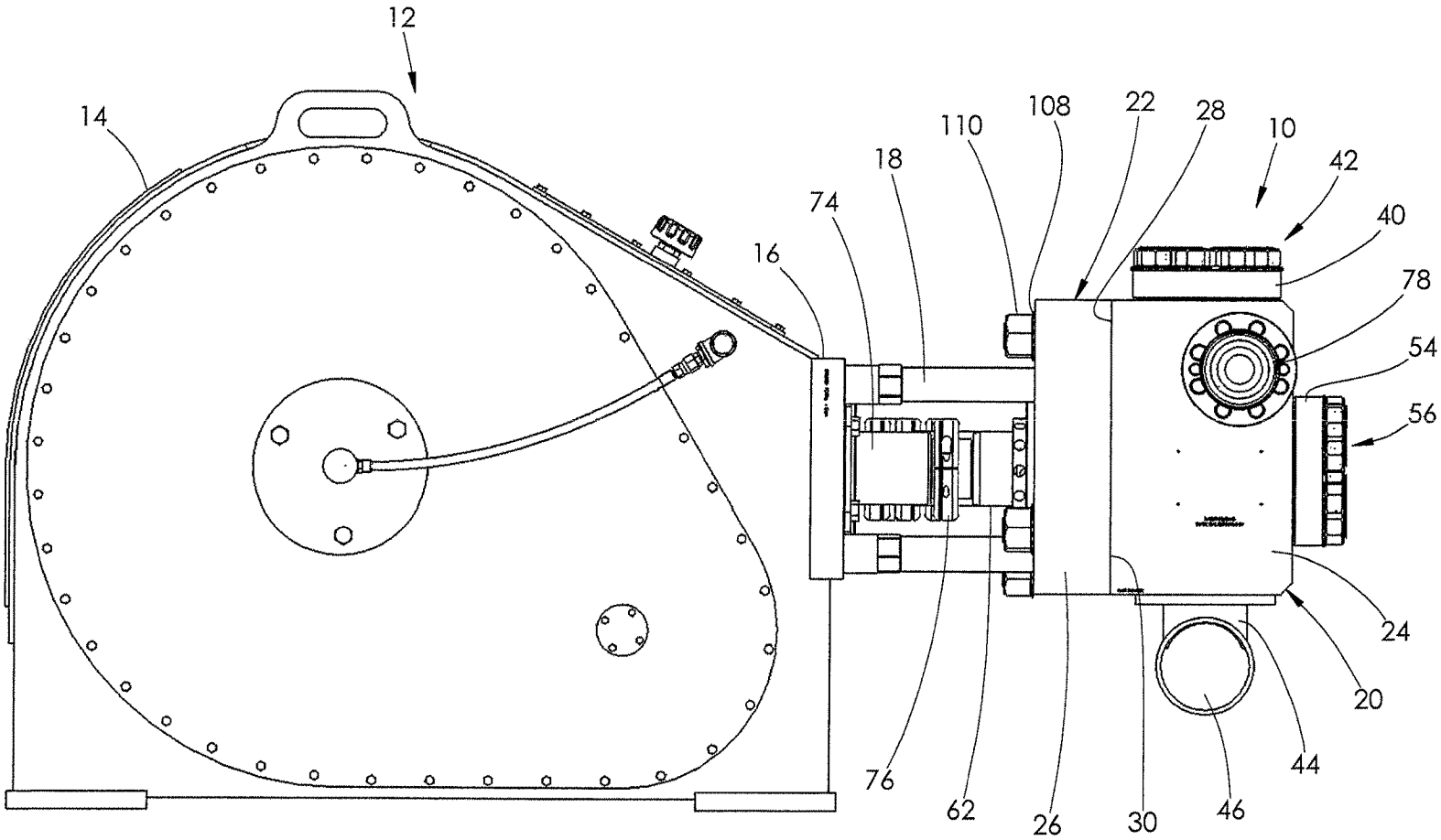
FIG. 2 is a side elevation view of the fluid end and power end shown in FIG. 1.

Turning now to the figures, FIGS. 1-2 show a fluid end 10 with two body pieces attached to a power end 12. The power end 12 comprises a housing 14 having a mounting plate 16 formed on its front end. A plurality of stay rods 18 attach to the mounting plate 16 and project from its surface. As will be discussed in more detail later herein, the fluid end 10 attaches to the projecting ends of the stay rods 18.

The fluid end 10 comprises a first body 20 releasably attached to a separate second body 22. The first and second bodies 20 and 22 both have a plurality of flat external surfaces 24, 26. Each surface 24, 26 may be rectangular in shape. The exterior surfaces 24 and 26 of each body 20 and 22 may be joined in the shape of a rectangular prism. However, the corner edges of such prism may be beveled. As will be discussed in more detail later herein, a back side 28 of the first body 20 is attached to a front side 30 of the second body 22. In some embodiments, the bodies 20 and 22 are attached such that a portion of the external surface 24 of the first body 20 is in flush engagement with a portion of the external surface 26 of the second body 22.

Figure 3:
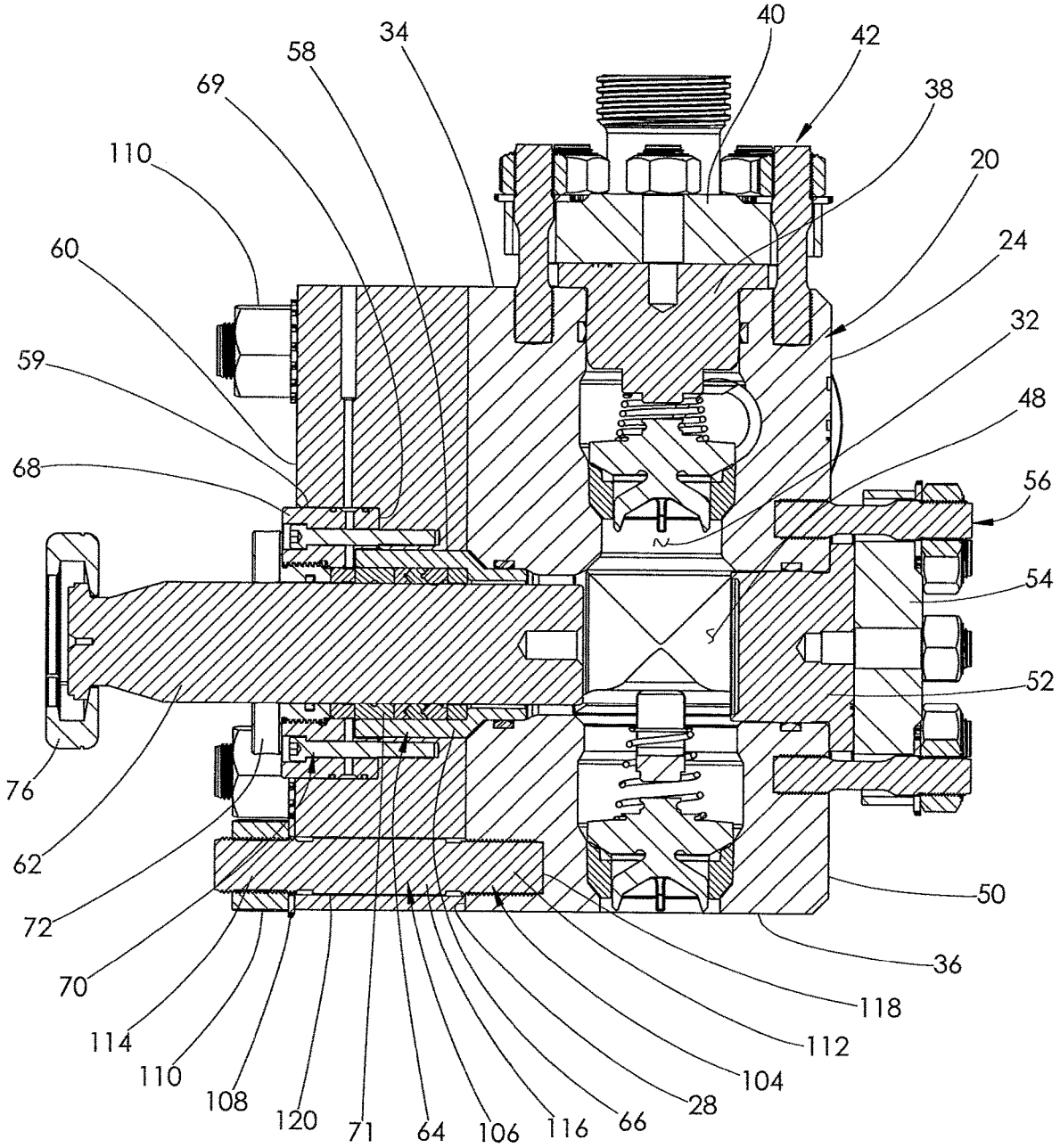
FIG. 3 is a cross-sectional view of the fluid end shown in FIG. 1, taken along line A-A. The inlet manifold has been removed for clarity.
Figure 4:
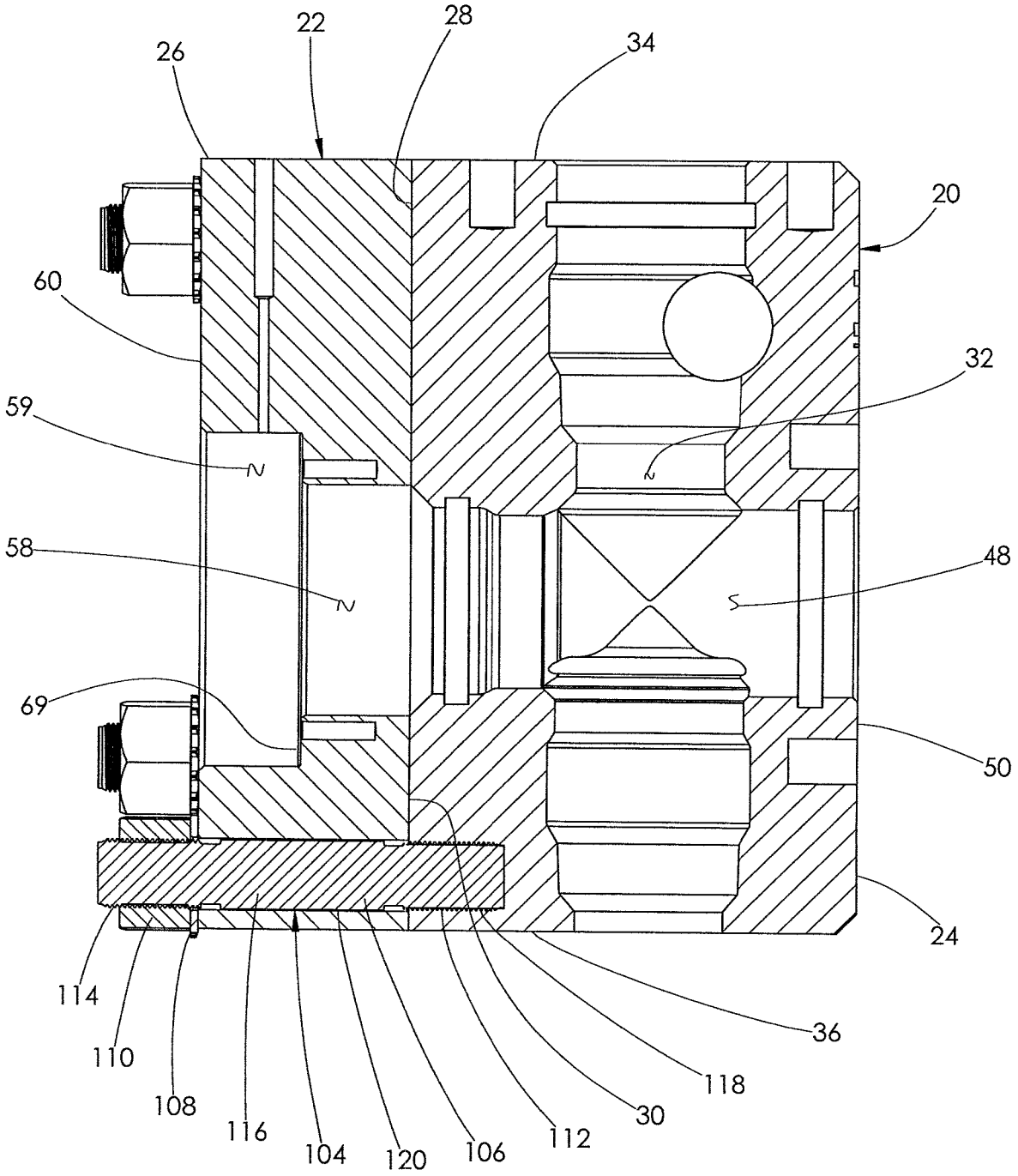
FIG. 4 is a cross-sectional view of the fluid end shown in FIG. 3. The inner and outer components of the fluid end have been removed for clarity.

With reference to FIG. 4, a plurality of rectilinear first bores 32, one of which is shown in FIG. 4, are formed in the first body 20. The plural first bores 32 are arranged in side-by-side relationship. Each of the first bores 32 extends through the entirety of the first body 20, interconnecting the top and bottom ends 34 and 36. At each of its opposed ends 34 and 36, the first bore 32 opens at the external surface 24. The diameter of each first bore 32 may vary throughout its length. Adjacent the top end 34 of the first body 20, each first bore 32 is closed by an installed component 38, as shown in FIG. 3. Each component 38 is releasably held within its first bore 32 by a retainer element 40 and fastening system 42, as shown in FIGS. 1-3, 5 and 6.

The components 38, retainer elements 40, and fastening system 42 shown in FIG. 3 may comprise those described in U.S. patent application Ser. No. 16/035,126, authored by Foster, et al. (the '126 Application), the entire contents of which are incorporated herein by reference. Likewise, the inner components of the fluid end 10, shown in FIG. 3, may comprise those inner components described in the '126 Application.

At the bottom end 36 of the first body 20, each of the first bores 32 is joined by a conduit 44 to an inlet manifold 46, as shown in FIGS. 1-2. Fluid enters the fluid end 10 through the conduits 44 of the inlet manifold 46.

Continuing with FIG. 4, a plurality of rectilinear second bores 48, one of which is shown in FIG. 4, are formed in the first body 20. The plural second bores 48 are arranged in side-by-side relationship. Each of the second bores 48 extends through the entirety of the first body 20, interconnecting the front and back sides 50 and 28. At each of its opposed sides 50 and 28, each second bore 48 opens at the external surface 24. Each of the second bores 48 intersects a corresponding one of the first bores 32. Each second bore 48 may be disposed in orthogonal relationship to its intersecting first bore 32.

Adjacent the front side 50 of the first body 20, each second bore 48 is closed by an installed component 52, as shown in FIG. 3, which may be identical to the component 38. Each component 52 is releasably held within its second bore 48 by a retainer element 54 and fastening system 56, as shown in FIGS. 1-3 and 5. The retainer element 54 may be identical to the retainer element 40, and the fastening system 56 may be identical to the fastening system 42.

Figure 6:
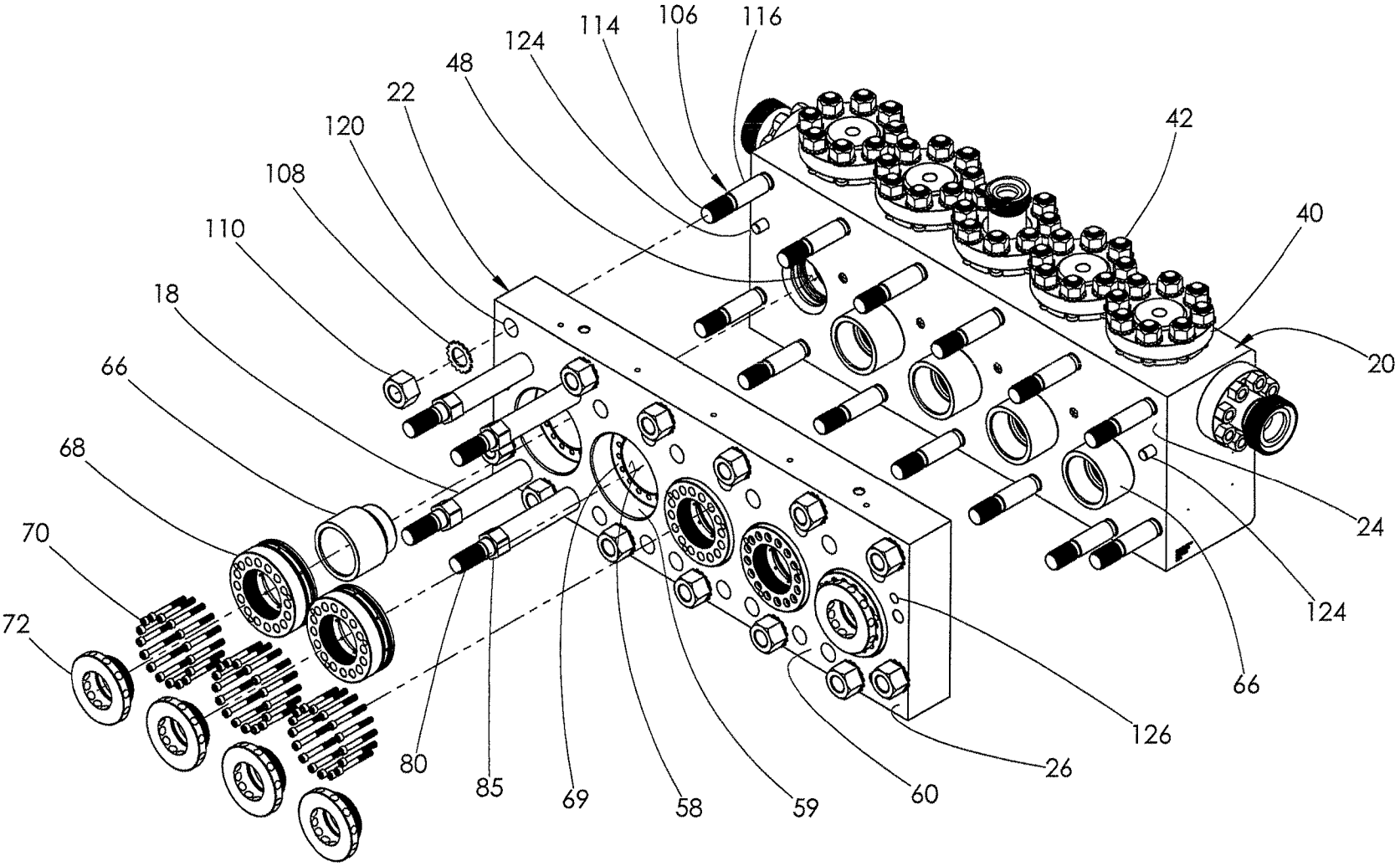
FIG. 6 is a partially exploded perspective view of a back side of the fluid end. A plurality of stay rods used to attach the fluid end to the power end are shown installed within a second body of the fluid end.
Figure 8:
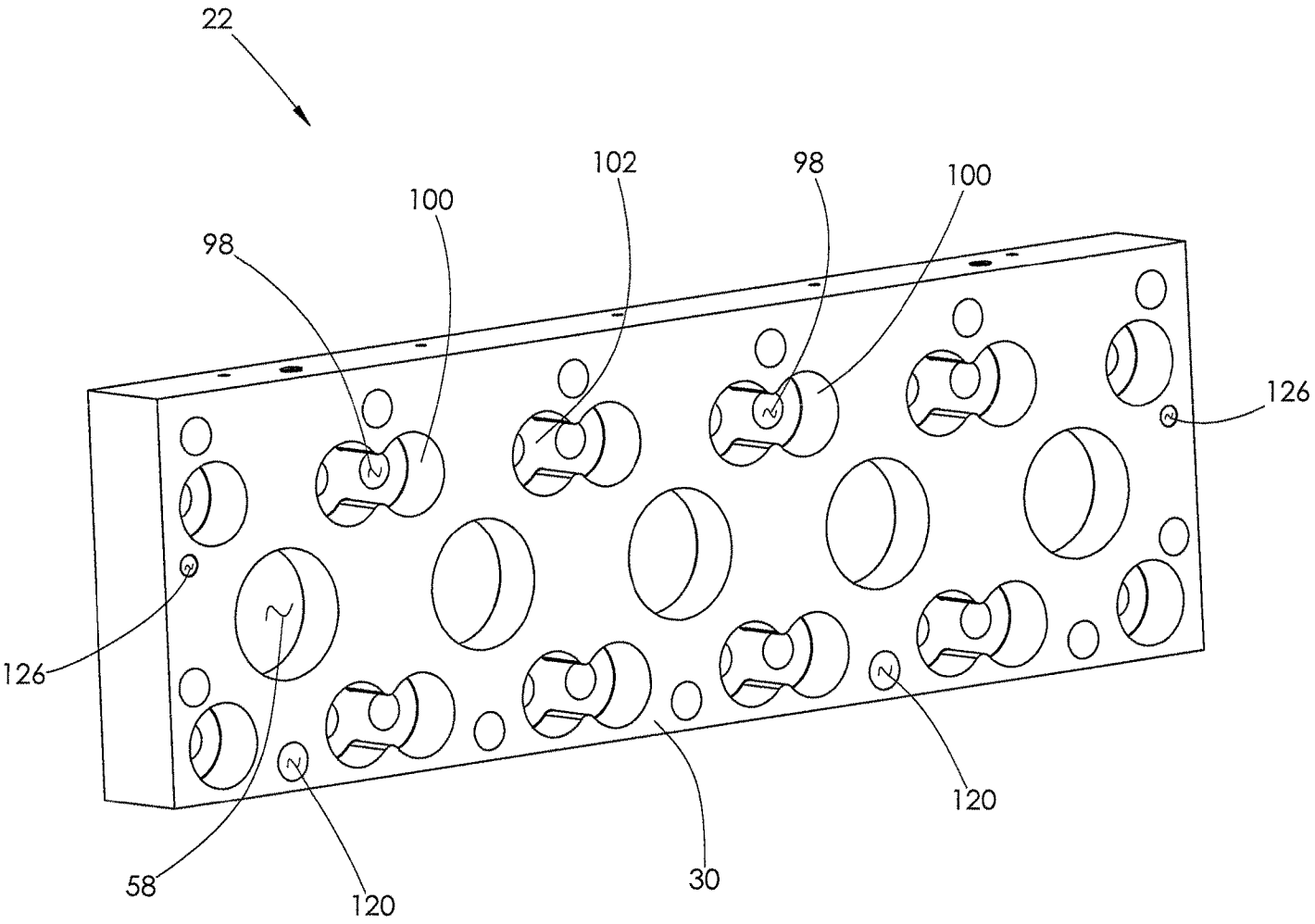
FIG. 8 is a perspective view of a front side of the second body of the fluid end shown in FIG. 6. The components installed within the second body have been removed for clarity.

With reference to FIGS. 4, 6 and 8, a plurality of rectilinear bores 58, one of which is shown in FIG. 4, are formed in the second body 22. The bores 58 are arranged in side-by-side relationship. Each of the bores 58 extends through the entirety of the second body 22, interconnecting the front and back sides 30 and 60. At each of its opposed sides 30 and 60, each bore 58 opens at the external surface 26. Each bore 58 includes a counterbore 59 formed adjacent the back side 60 of the second body 22, as shown in FIGS. 4 and 6. Each bore 58 formed in the second body 22 registers with a corresponding one of the second bores 48 formed in the first body 20. When the bodies 20 and 22 are joined and aligned, each bore 58 becomes an extension of its associated second bore 48, as shown in FIG. 4.

With reference to FIG. 3, a plunger 62 is installed within each pair of aligned bores 48 and 58. A sealing arrangement 64 is installed within each pair of aligned bores 48 and 58, and surrounds the plunger 62 within those bores. Each sealing arrangement 64 comprises a stuffing box sleeve 66 that houses a series of annular packing seals 71. The stuffing box sleeves 66 and packing seals 71 may be selected from those described in the '126 Application.

A retainer element 68 is installed within each bore 58, and holds the stuffing box sleeve 66 within such bore. Each retainer element 68 is secured to a flat bottom 69 of the counterbore 59 of its associated bore 58. A fastening system 70 holds the retainer element 68 in place. The seals 71 are compressed by a packing nut 72 threaded into an associated retainer element 68. The retainer elements 68, fastening system 70, plungers 62, and packing nuts 72 may be selected from those described in the '126 Application.

Turning back to FIGS. 1-2, the power end 12 comprises a plurality of pony rods 74. Pony rods are known in the art as elongate rods that interconnect the crankshaft of a power end to each of the plungers positioned within a fluid end. Each pony rod 74 extends through a corresponding opening formed in the mounting plate 16. Each pony rod 74 is attached to a corresponding one of the plungers 62 by means of a clamp 76. An engine attached to the power end 12 drives reciprocating movement of the pony rods 74. Such movement of the pony rods 74 causes each plunger 62 to reciprocate within its associated pair of aligned bores 48 and 58. High pressure fluid pumped through the fluid end 10 by the plungers 62 exits the fluid end 10 through one or more outlet conduits 78.

Figure 7:
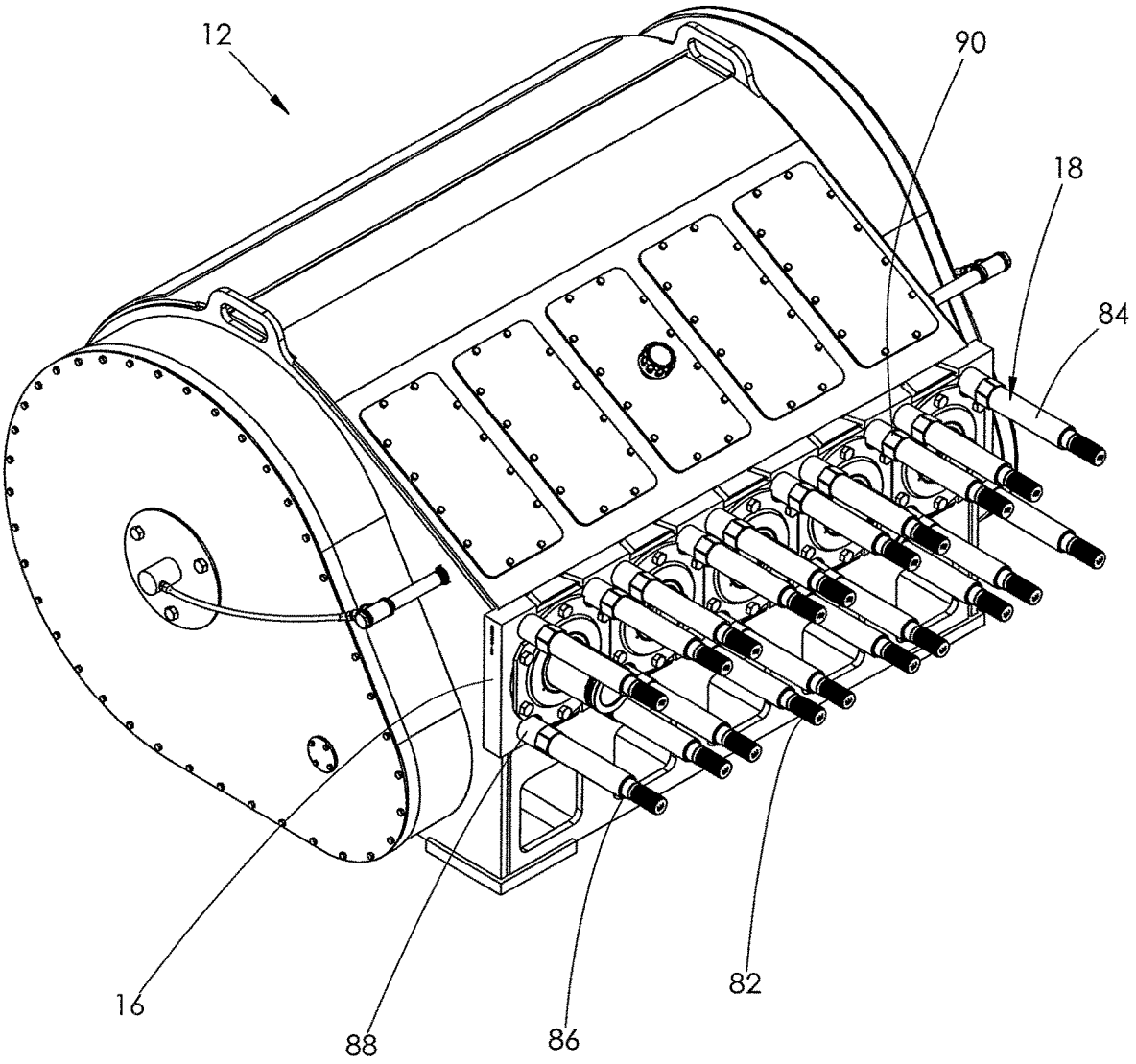
FIG. 7 is a perspective view of the power end shown in FIG. 1 with the stay rods attached thereto. The fluid end has been removed for clarity.

With reference to FIGS. 6 and 7, each stay rod 18 comprises a cylindrical body 84 having opposed first and second ends 80 and 82. External threads are formed in the body 84 adjacent each of its ends 80 and 82. These threaded portions of the body 84 are of lesser diameter than the rest of the body 84. A step separates each threaded portion of the body from its unthreaded portion. Step 85 is situated adjacent the first end 80, and step 86 is situated adjacent the second end 82.

Continuing with FIG. 7, a plurality of internally threaded connectors 88 are supported on the front surface of the mounting plate 16. Each connector 88 mates with the threaded first end 80 of a corresponding stay rod 18. An integral nut 90 is formed on each stay rod 18 adjacent its first end 80. The nut 90 provides a gripping surface where torque may be applied to the stay rod 18 during installation. Once a stay rod 18 has been installed in a connector 88, its second end 82 projects from the front surface of the mounting plate 16. In alternative embodiments, the stay rods 18 may thread directly into holes formed in the mounting plate.

Figure 9:
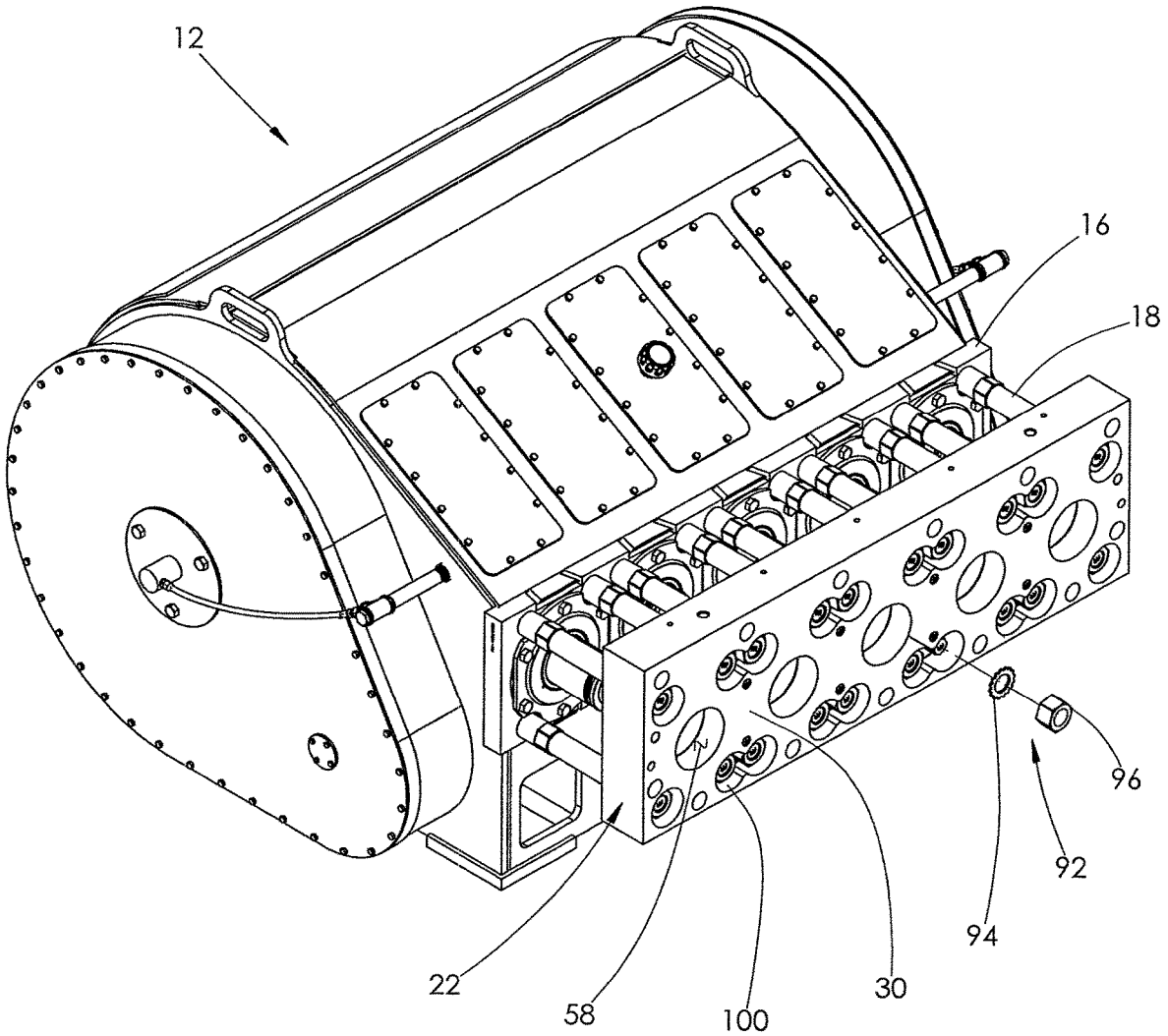
FIG. 9 is a perspective view of the power end of FIG. 7 with the second body of FIG. 8 attached thereto. The first body of the fluid end has been removed for clarity. A portion of the fastening system used to secure the second body to the power end is shown exploded for reference.
Figure 10:
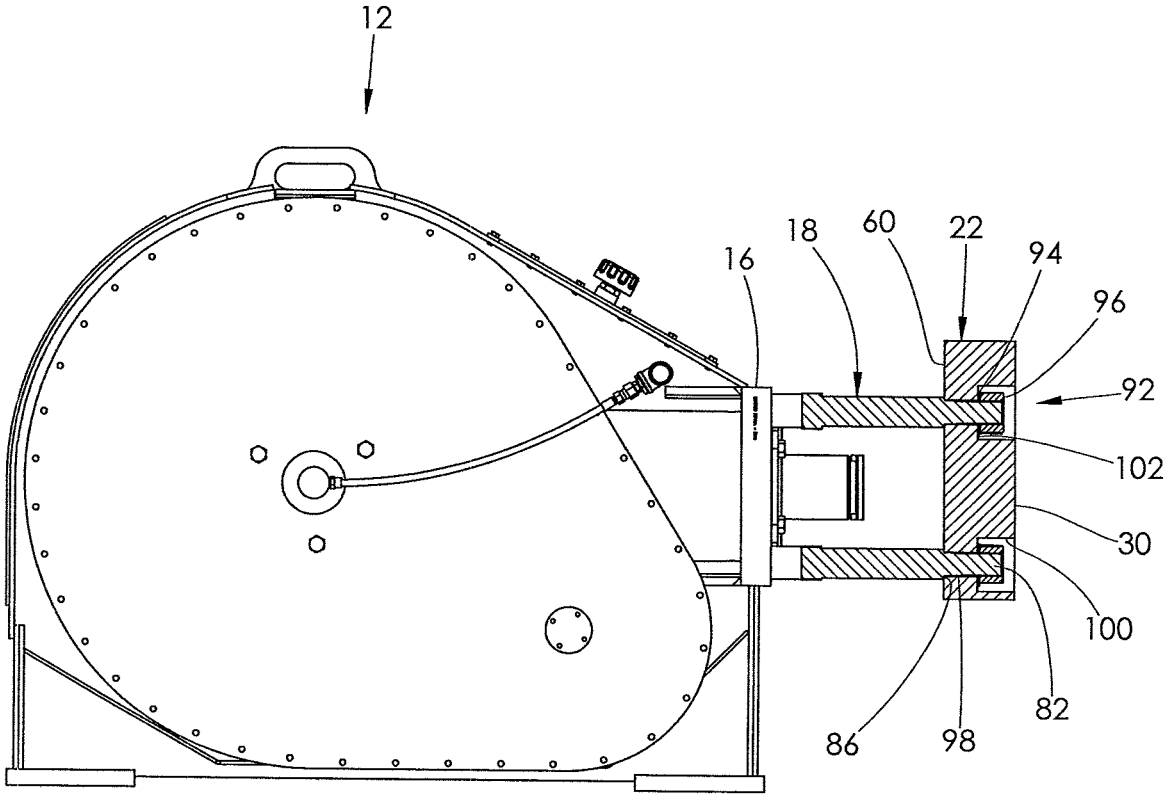
FIG. 10 is a side elevation view of the power end and attached second body shown in FIG. 9. The second body and stay rods attaching the second body to the power end are shown in cross-section.

With reference to FIGS. 8-10, the second body 22 is secured to the stay rods 18 using a fastening system 92. The fastening system 92 includes a plurality of washers 94 and a plurality of internally threaded nuts 96. A plurality of bores 98 are formed about the periphery of the second body 22. The number of bores 98 may equal the number of stay rods 18. A single stay rod 18 is installed within each of the bores 98, at its second end 82, as shown in FIG. 10. Each bore 98 includes a counterbore 100 formed adjacent the front side 30 of the second body 22, as shown in FIGS. 8 and 10. Adjacent counterbores 100 may overlap each other, as shown in FIGS. 8 and 9. In alternative embodiments, each bore may be spaced from each adjacent bore such that their respective counterbores do not overlap.

A stay rod 18 is installed by inserting its second end 82 into the opening of the bore 98 formed in the back side 60 of the second body 22. The stay rod 82 is extended into the bore 98 until the step 86 abuts the back side 60, as shown in FIG. 10.

When a stay rod 18 is installed, its second end 82 projects within the counterbore 100 of its associated bore 98. To secure each stay rod 18 to the second body 22, a washer 94 and nut 96 are installed on the second end 82 of the stay rod 18, as shown in FIGS. 9 and 10. Each nut 96 and its underlying washer 94 press against a flat bottom 102 of the counterbore 100 within which they are installed. Each nut 96 is fully submerged within its recessed counterbore 100.

Figure 5:
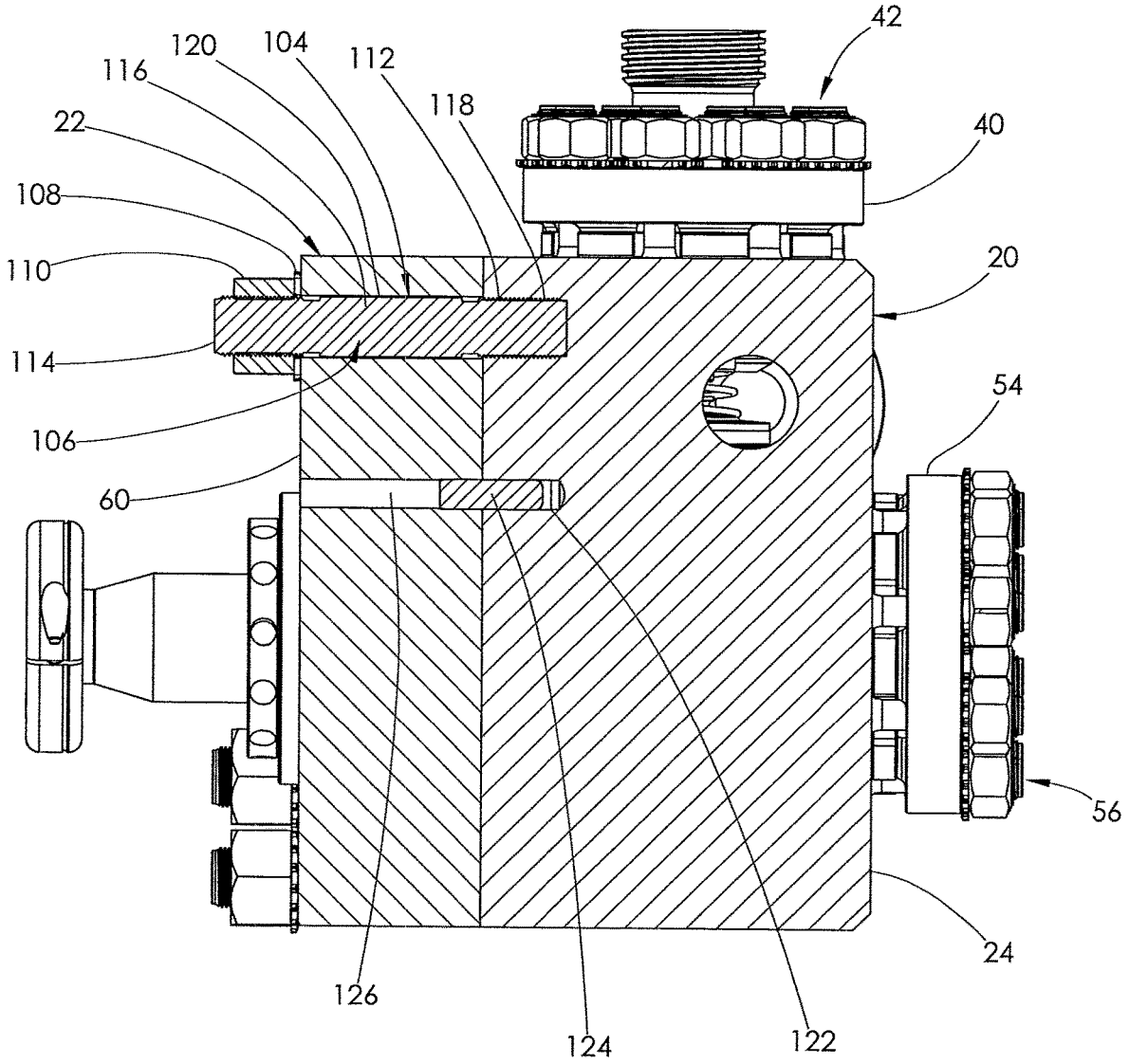
FIG. 5 is a cross-sectional view of the fluid end shown in FIG. 1, taken along line B-B. The inlet manifold has been removed for clarity.

With reference to FIGS. 3-6, the first body 20 is secured to the second body 22 using a fastening system 104. The fastening system 104 comprises a plurality of studs 106, a plurality of washers 108, and plurality of internally threaded nuts 110. Each stud 106 comprises a cylindrical body 116 having a pair of opposed ends 112 and 114, as shown in FIGS. 3-5. Each of the ends 112 and 114 is externally threaded.

A plurality of internally threaded openings 118 are formed about the periphery of the first body 20, as shown in FIGS. 3-5. The first end 112 of each stud 106 mates with a corresponding one of the openings 118. Once a stud 106 has been installed in the first body 20, its second end 114 projects from the body's external surface 24, as shown in FIG. 6.

A plurality of through-bores 120 are formed about the periphery of the second body 22, as shown in FIGS. 3-5. The through-bores 120 are alignable with the plural studs 106 projecting from the first body 20.

To assemble the first and second bodies 20 and 22, the plural studs 106 are installed in the plural openings 118 of the first body 20. The first body 20 and installed studs 106 are positioned such that each through-bore 120 formed in the second body 22 is aligned with a corresponding stud 106. The first and second bodies 20 and 22 are then brought together such that each stud 106 is received within a corresponding through-bore 120. When the bodies 20 and 22 are thus joined, the second end 114 of each stud 106 projects from the back side 60 of the second body 22. Finally, a washer 108 and nut 110 are installed on the second end 114 of each stud 106, as shown in FIGS. 2-5, thereby securing the bodies together.

Continuing with FIG. 5, one or more pin bores 122 may be formed in the first body 20 adjacent its outer edges. Each pin bore 122 may receive a pin 124 that projects from the external surface 24 of the first body 20, as shown in FIGS. 5 and 6. These pins 124 may be installed within a corresponding bore 126 formed in the second body 22, as shown in FIGS. 5 and 6. The pins 124 help align the first and second bodies 20 and 22 during assembly of the fluid end 10.

The concept of a "kit" is described herein due to the fact that fluid ends are often shipped or provided unassembled by a manufacturer, with the expectation that an end customer will use components of the kit to assemble a functional fluid end. Accordingly, certain embodiments within the present disclosure are described as "kits," which are unassembled collections of components. The present disclosure also describes and claims assembled apparatuses and systems by way of reference to specified kits, along with a description of how the various kit components are actually coupled to one another to form the apparatus or system.

Several kits are useful for assembling the fluid end 10. A first kit comprises the first body 20 and the second body 22. The first kit may also comprise the fastening system 92 and/or the fastening system 104. The first kit may further comprise the components 38 or 52, sealing arrangements 64, retainer elements 40, 54 or 68, fastening systems 42, 56 or 70, packing nuts 72, plungers 62, and/or clamps 72, described herein.

With reference to FIGS. 6-8, the positioning of the bores 98 around the periphery of the second body 22 corresponds with the positioning of the stay rods 18 on the mounting plate 16. Thus, each second body 22 is constructed specifically to match different stay rod 18 spacing configurations known in the art.

As shown in FIGS. 2-6, the second body 22 has a lesser thickness than the first body 20 (thickness being measured in FIG. 2 along the line A-A, for example). However, the bodies 20 and 22 have the same depth and height, so that they form a rectangular prism when assembled. Thus, the front side of the second fluid end body and the back side of the first fluid body may have the same dimensions in some embodiments. In other embodiments, the dimensions of these opposing sides may be different. Also, it is noted that the corner edges of such prism may be beveled.

The first and second bodies 20, 22 may be formed from a strong durable material, such as steel. Because the first body 20 must receive fluids under conditions of high pressure, it may be formed from stainless steel or cast iron. In contrast, the second body 22 does not receive high pressure fluids: it serves only as a connection between the power end 12 and the first body 20. The second body 22 can thus be formed from a different, lower strength, and less costly material than the first body 20. For example, when the first body 20 is formed from stainless steel, the second body can be formed from a less costly alloy steel. Alternatively, the first and second bodies may be formed from the same material, such as stainless steel.

In order to manufacture the fluid end 10, the first and second bodies 20 and 22 are each cut to size from blocks of steel. Multiple first or second bodies 20 or 22 may be forged from the same block. In such case, the bodies 20 and 22 may be forged by dividing the block parallel to its length into multiple rectangular pieces. Because a flange is not forged from the block, material that is typically discarded may instead be used to form one of the first or second bodies 20 or 22. If the bodies 20 and 22 are formed from the same material, the first and second body 20 and 22 may be forged from the same block.

After the bodies 20 and 22 are formed, the bores and openings described herein are machined into each body 20 and 22. The studs 106, as well as the internal components shown in FIG. 3, including the components 38, retainer elements 40 and fastening system 42, are next installed in the first body 20. After the necessary bores have been formed in the second body 22, the sealing arrangements 64, retainer elements 68, fastening system 70, plungers 62 and packing nuts 72 described herein are installed. Prior to operation, the second body 22 is attached to the power end 12, and the first body 20 is attached to the second body 22.

During operation, the pumping of high pressure fluid through the fluid end 10 causes it to pulsate or flex. Such motion applies torque to the fluid end 10. The amount of torque applied to the fluid end 10 corresponds to the distance between the power end 12 and the front side 50 of the fluid end: the moment arm.

In flanged fluid ends, such as the fluid end 300 shown in FIGS. 14 and 15, the applied torque is known to cause fatigue failures at the flanged connection point. A flanged connection point 310 is shown in FIGS. 14 and 15. Flanged fluid ends require space between the flange and the fluid end body to operate a wrench, as shown by a space 312 in FIGS. 14 and 15. Such space is not needed with the fluid end 10. Thus, the moment arm associated with the fluid end 10 is decreased from that associated with flanged fluid ends. Therefore, less torque is applied to the fluid end 10 during operation than flanged fluid ends, which makes the fluid end 10 less susceptible to fatigue failures.

Figure 11:
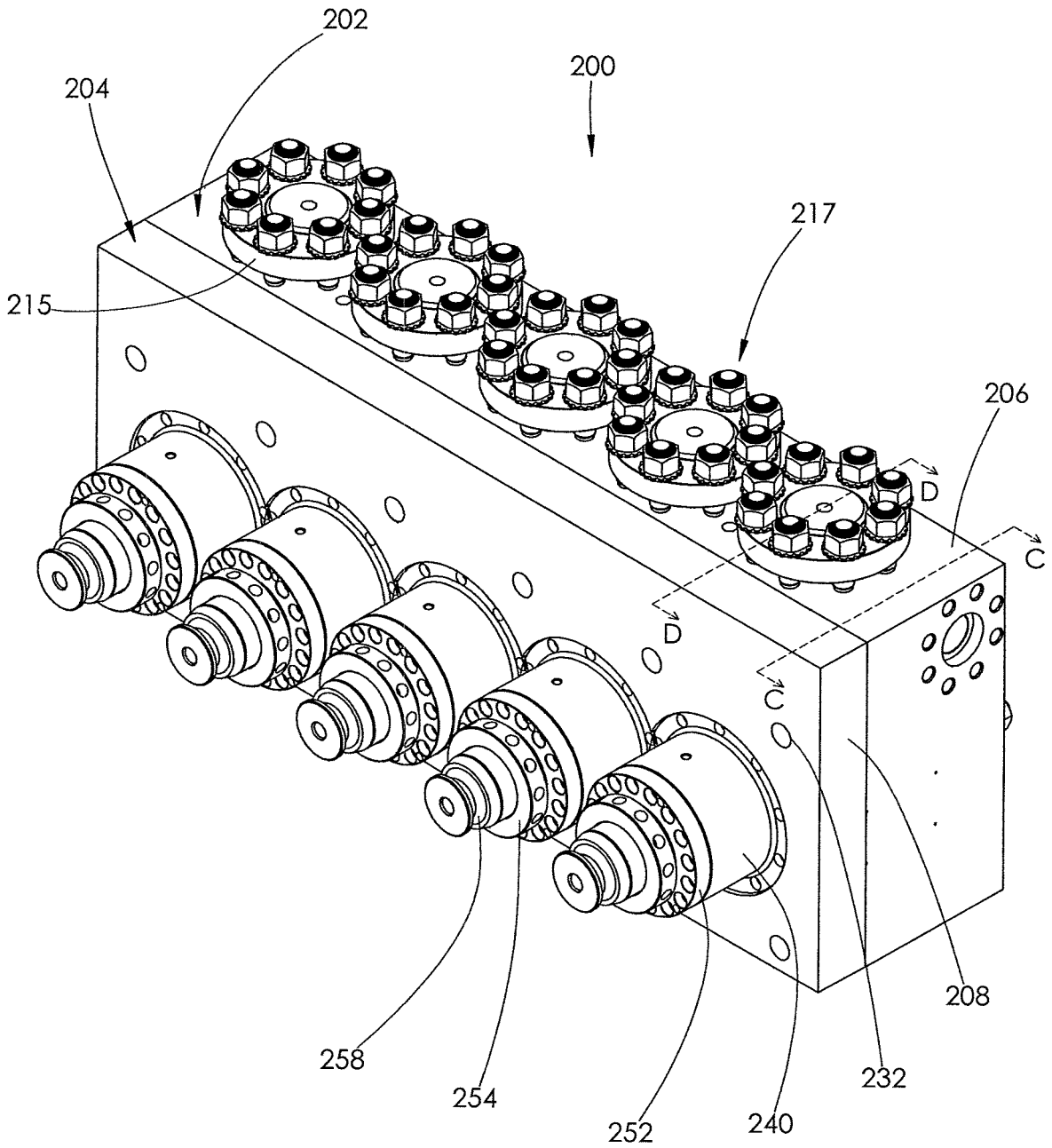
FIG. 11 is a perspective view of a back side of an alternative embodiment of a fluid end.
Figure 12:
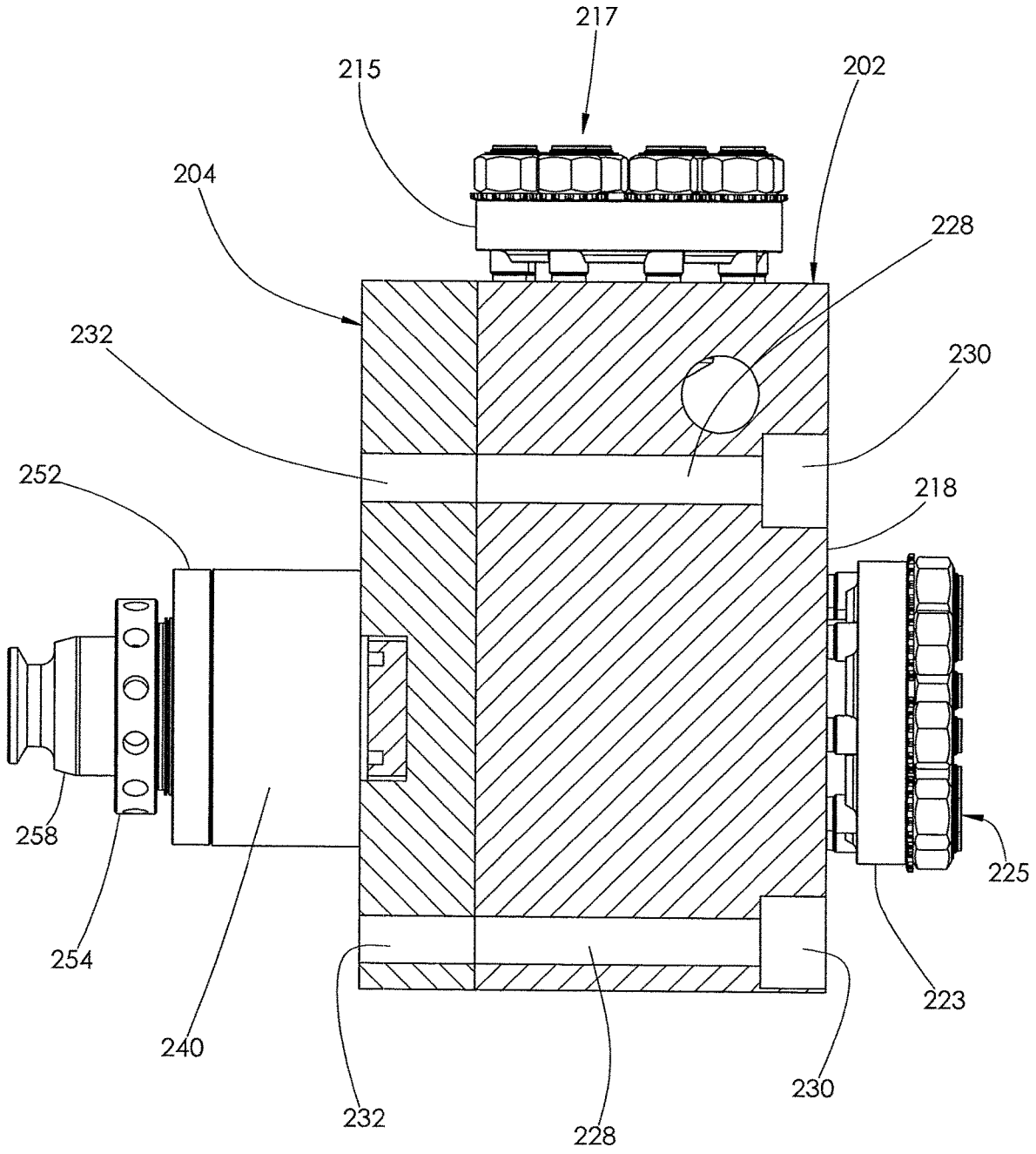
FIG. 12 is a cross-sectional view of the fluid end shown in FIG. 11, taken along line C-C.
Figure 13:
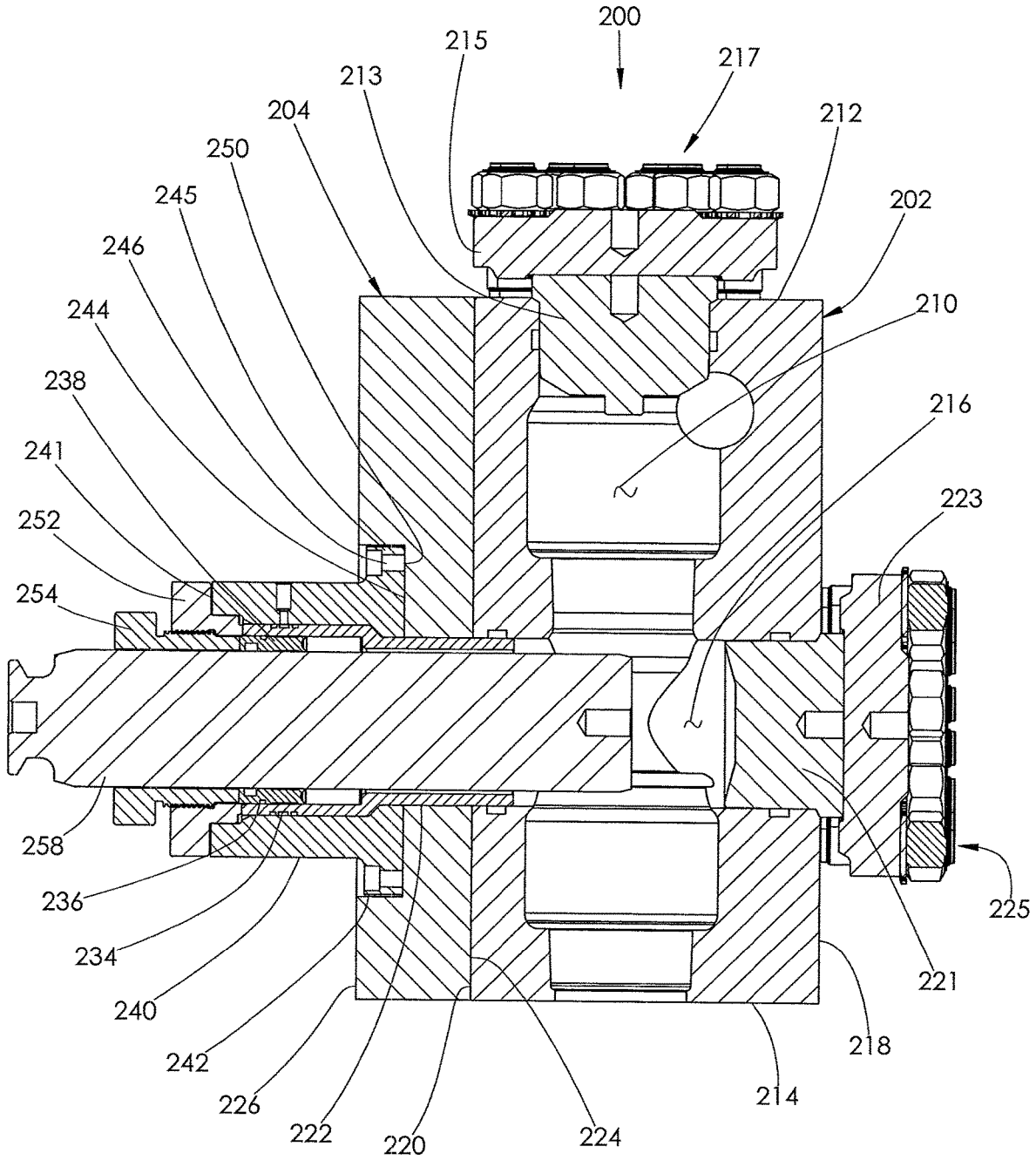
FIG. 13 is a cross-sectional view of the fluid end shown in FIG. 11, taken along line D-D.

Turning to FIGS. 11-13, an alternative embodiment of a fluid end 200 is shown. The fluid end 200 comprises a first body 202 attached to separate second body 204. The second body 204 is machined to have a lesser thickness than that of the second body 22, shown in FIGS. 1-2. As described later herein, providing the second body 204 with a lesser thickness allows the first and second bodies 202 and 204 to be attached together using a single fastening system.

Continuing with FIGS. 11-13, the first and second bodies 202 and 204 each have a plurality of flat external surfaces 206 and 208. The surfaces 206 and 208 may be rectangular in shape. The exterior surfaces 206 and 208 of each body 202 and 204 may be joined in the shape of a rectangular prism. However, the corner edges of such prism may be beveled.

With reference to FIG. 13, a plurality of rectilinear first bores 210, one of which is shown in FIG. 13, are formed in the first body 202. The plural bores 210 are arranged in side-by-side relationship. Each first bore 210 extends through the entirety of the first body 202, interconnecting its top and bottom ends 212 and 214. At each of its opposed ends 212 and 214, the first bore 210 opens at the external surface 206.

Adjacent the top end 212 of the first body 202, each first bore 210 is closed by an installed component 213. Each component 213 is releasably held within its first bore 210 by a retainer element 215 and fastening system 217, as shown in FIGS. 11-13. The components 213, retainer elements 215, and fastening system 217 may be selected from those described in the '126 Application.

Continuing with FIG. 13, a plurality of rectilinear second bores 216, one of which is shown in FIG. 13, are formed in the first body 202. The plural second bores 216 are arranged in side-by-side relationship. Each second bore 216 extends through the entirety of the first body 202, interconnecting its front and back sides 218 and 220. At each of its opposed sides 218 and 220, each second bore 216 opens at the external surface 206. The second bores 216 each intersect a corresponding one of the first bores 210. Each second bore 216 may be disposed in orthogonal relationship to its intersecting first bore 210.

Adjacent the front side 218, each second bore 216 is closed by an installed component 221, which may be identical to the component 213. Each component 221 is releasably held within its second bore 216 by a retainer element 223 and fastening system 225, as shown in FIGS. 12 and 13. The retainer element 223 may be identical to the retainer element 215, and the fastening system 225 may be identical to the fastening system 217.

Continuing with FIG. 13, a plurality of bores 222, one of which is shown in FIG. 13, are formed in the second body 204. The bores 222 are arranged in side-by-side relationship. Each bore 222 extends through the entirety of the second body 204, interconnecting its front and back sides 224 and 226. At each of its opposed sides 224 and 226, each bore 222 opens at the external surface 208. Each bore 222 formed in the second body 204 registers with a corresponding one of the second bores 216 formed in the first body 202. When the bodies 202 and 204 are joined and aligned, each bore 222 becomes an extension of its associated second bore 216.

With reference to FIG. 12, a plurality of bores 228 are formed in the outer periphery of the first body 202. Each bore 228 includes a counterbore 230 positioned immediately adjacent the front side 218 of the first body 202. The bores 228 are each alignable with a plurality of corresponding through-bores 232 formed about the periphery of the second body 204, as shown in FIGS. 11-12.

A fastening system is used to secure the first body 202 to the second body 204. The fastening system comprises a plurality of stay rods, similar to stay rods 18, and a plurality of nuts and washers. The stay rods are installed within each aligned bore 228 and 232. A nut and washer is torqued on the end of each stay rod within each corresponding counterbore 230. The bodies 202 and 204 are attached such that the back side 220 of the first body 202 is in flush engagement with the front side 224 of the second body 204.

Continuing with FIG. 12, in order for a stay rod to extend the length between the first and second bodies 202 and 204, the second body 204 is machined to have a lesser thickness than the second body 22, shown in FIGS. 1-6. Such decrease in size is possible because a plurality of sealing arrangements 234 used with the second body 204 are primarily positioned outside of the second body 204, as shown in FIG. 13. Each sealing arrangement 234 comprises a stuffing box sleeve 236 that houses a series of packing seals 238. The stuffing box sleeves 236 and packing seals 238 may be selected from those described in the '126 Application.

As shown in FIG. 13, each bore 222 formed in the second body 204 includes a counterbore 242 that opens on the back side 226 of the second body 204. A removable box gland 240 is closely received within each counterbore 242. The removable box glands 240 are each tubular sleeves having open first and second ends 241 and 244. Each second end 244 has a flanged outer edge 245 that is sized to be closely received within each counterbore 242. Each sealing arrangement 234 is housed at least partially within a corresponding removable box gland 240.

A plurality of openings 246 are formed in the flanged outer edge 245 of each box gland 240. The openings 246 correspond with a plurality of openings (not shown) formed in a flat bottom 250 of each counterbore 242. A plurality of fasteners may be installed within the opening 246 and the opening formed in the bottom 250. When installed, the fasteners releasably secure each box gland 240 to the second body 204.

Continuing with FIG. 11-13, a retainer element 252 and fastening system hold the sleeve 236 within the box gland 240 and aligned with bores 222 and 242, as shown in FIG. 13. The retainer element 252 and fastening system may be the same as the retainer element 68 and fastening system 70, as shown in FIG. 3. The seals 238 are compressed by a packing nut 254 threaded into an associated retainer element 252, as shown in FIG. 13. A plunger 258 is installed within each pair of aligned bores 216 and 222.

Several kits are useful for assembling the fluid end 200. A first kit comprises the first body 202 and the second body 204. The first kit may also comprise the fastening system described with reference to FIG. 13 to attach the bodies 202 and 204. The first kit may further comprise the components 213 or 221, removable box glands 240, sealing arrangements 234, retainer elements 215, 223 or 252, fastening system 217, 225 or the fastening system used with the box gland 240, packing nuts 254, and/or plungers 258, described herein.

The bodies 202 and 204 may be formed of the same material as the bodies 20 and 22. Likewise, the bodies 202 and 204 may be manufactured in the same manner as the bodies 20 and 22.

The plurality of washers used with each fastening system 92 and 104, shown in FIGS. 3-6, 9 and 10, may be configured to allow a large amount of torque to be applied to the nuts without using a reaction arm. Instead, the washer itself may serve as the counterforce needed to torque a nut onto a stud. Not having to use a reaction arm increases the safety of the assembly process. The same is true for the washers that may be used with the fastening system described with reference to FIG. 12.

The nuts used with the fastening systems 92 and 104 may also comprise a hardened inner layer to help reduce galling between the threads of the nuts and studs during the assembly process. The same is true for the nuts that may be used with the fastening system described with reference to FIG. 12. An example of the above described washers, nuts, and methods are described in Patent Cooperation Treaty Application Serial No. PCT/US2017/020548, authored by Junkers, et al.

Changes may be made in the construction, operation and arrangement of the various parts, elements, steps and procedures described herein. For example, certain embodiments of the second fluid end body piece (or pieces) are described above as "flangeless." In other embodiments, a minimally flanged fluid end body piece may also be utilized. Consider the surface dimension of the wider portion of the flanged piece to the narrower portion of the piece-for example, the height of the portion of flange 302 in FIG. 14 to the height of the narrower portion that engages with the first body piece. In one set of embodiments, the ratio r of the height (or other corresponding surface dimension) of the narrower portion to the height (or other corresponding surface dimension) of the wider portion may be $0.90<r<1.0$; in other embodiments the ratio r may be $0.95<r<1.0$.

The invention claimed is:

1. A kit comprising:

a first fluid end body, comprising:

an external surface having a front side and an opposed back side and opposed top and bottom ends; and a plurality of bore pairs, each bore pair comprising:

a first bore extending through the first fluid end body and terminating at openings formed in the top and bottom ends; the first bore configured to receive an intake valve and a discharge valve; and a second bore extending through the first fluid end body, intersecting the first bore, and terminating at openings formed in the front and back sides; the second bore configured to receive at least a portion of a plunger; and a second fluid end body, formed as a different piece from the first fluid end body, and comprising:

an external surface having a front side and an opposed back side, in which the front side of the second fluid end body is positionable to engage the back side of the first fluid end body;

a plurality of bores extending through the second fluid end body, each bore terminating at an opening formed in the external surface, each opening alignable with a corresponding opening formed in the back side of the first fluid end body; and a plurality of passages extending through the second fluid end body, each of the plurality of passages opening on the back side of the second fluid end body and opening into one of a plurality of counterbores on the front side of the second fluid end body, each passage of the plurality of passages configured to receive one of a plurality of stay rods such that an end of each stay rod is situated within a corresponding one of the plurality of counterbores;

in which the end of each of the plurality of stay rods is configured to receive a threaded nut such that one or more threaded nuts are enclosed within each of the plurality of counterbores when the front side of the second fluid end body is engaged with the back side of the first fluid end body; and in which the plurality of stay rods are configured to releasably attach the second fluid end body to a power end such that the second fluid end body and the power end are in a spaced relationship.

2. The kit of claim 1 further comprising:

a first fastening system configured to releasably hold the first fluid end body against the second fluid end body.

3. The kit of claim 2 in which the fastening system comprises:

a plurality of externally threaded studs-supported by the first fluid end body and projecting from the back side of the first fluid end body;

a plurality of fastener openings formed about the periphery of the second fluid end body, each fastener opening registerable with a corresponding one of the studs; and a plurality of internally threaded nuts, each nut configured for installation on a corresponding one of the studs.

4. The kit of claim 3 in which the fastening system further comprises:

a plurality of washers, each washer configured for installation on one of the studs.

5. An apparatus, comprising:

the kit of claim 3 in which the first fluid end body is positioned in flush engagement with the second fluid end body, a stud extends through each peripheral fastener opening of the second fluid end body, and each stud carries a nut that engages the second fluid end body.

6. A system, comprising:

the apparatus of claim 5; and high-pressure fluid contained within the first fluid end body.

7. A system comprising:

an engine; and the apparatus of claim 5 connected to the engine.

8. The kit of claim 1 in which each bore of the second fluid end body is configured to receive a sealing arrangement for a plunger.

9. The kit of claim 1 further comprising a plurality of removable box glands, in which each bore of the second fluid end body is configured to receive one of the plurality of removable box glands.

10. The kit of claim 9, in which each of the plurality of removable box glands are configured to be installed within a corresponding one of the bores through the opening of the bore on the back side of the second fluid end body.

11. The kit of claim 1 in which no bore intersects any of the bores formed in the second fluid end body.

12. An apparatus comprising the kit of claim 9 in which each of the removable box glands projects from the external surface of the second body when installed within each bore extending through the second body.

13. The kit of claim 9 in which each removable box gland is configured to receive a plunger.

14. The kit of claim 1 in which the thickness of the first fluid end body is greater than the thickness of the second fluid end body.

15. The kit of claim 14 in which the first and second fluid end bodies have the same depth and height.

16. The kit of claim 1 in which the first and second fluid end bodies are formed from different materials.

17. The kit of claim 16 in which the first fluid end body is formed from a stronger material than the second fluid end body.

18. The kit of claim 1 in which the front side of the second fluid end body is positionable to flushly engage with the back side of the first fluid end body.

19. The kit of claim 1 in which the front side of the second fluid end body is positionable to partially engage with the back side of the first fluid end body.

20. The kit of claim 1 in which the front side of the second fluid end body is positionable to engage with the back side of the first fluid end body via one or more spacer elements.

21. The kit of claim 1, wherein the second fluid end body is flangeless.

22. The kit of claim 1, in which at least two of the counterbores overlap one another.

23. A method for assembling the kit of claim 1, the method comprising:

attaching the second fluid end body to a plurality of stay rods; and attaching the first fluid end body to the second fluid end body; in which the first fluid end body is separated from the second fluid end body prior to attaching the first fluid end body to the second fluid end body.

24. An apparatus, comprising:

a first fluid end body, comprising:

an external surface having a front side and an opposed back side and opposed top and bottom ends; and a plurality of bore pairs, each bore pair comprising:

a first bore extending through the first fluid end body and terminating at openings formed in the top and bottom ends;

the first bore configured to receive an intake valve and a discharge valve; and a second bore extending through the first fluid end body, intersecting the first bore, and terminating at openings formed in the front and back sides; the second bore configured to receive at least a portion of a plunger; and a second fluid end body, formed as a different piece from the first fluid end body, and comprising:

an external surface having a front side and an opposed back side;

a plurality of bores extending through the second fluid end body, each bore terminating at an opening formed in the external surface, each opening alignable with a corresponding opening formed in the back side of the first fluid end body; and a plurality of passages extending through the second fluid end body, each of the plurality of passages opening on the back side of the second fluid end body and opening into one of a plurality of counterbores on the front side of the second fluid end body, each passage of the plurality of passages configured to receive one of a plurality of stay rods such that an end of each stay rod is situated within a corresponding one of the plurality of counterbores;

in which the plurality of stay rods are configured to releasably attach the second fluid end body to a power end such that the second fluid end body and the power end are in a spaced relationship;

in which the first fluid end body is attached to the second fluid end body such that the back side of the first fluid end body is held against the front side of the second fluid end body; and in which the end of each of the plurality of stay rods is configured to receive a threaded nut such that one or more threaded nuts are enclosed within each of the plurality of counterbores when the back side of the first fluid end body is held against the front side of the second fluid end body.

25. The apparatus of claim 24 further comprising:

a first fastening system holding the first fluid end body flush against the second fluid end body.

26. The apparatus of claim 25 in which the first fastening system comprises:

a plurality of externally threaded studs supported by the first fluid end body and projecting from the back side of the first fluid end body;

a plurality of fastener openings formed about the periphery of the second fluid end body, each fastener opening registerable with a corresponding one of the studs; and a plurality of internally threaded nuts installed on a corresponding one of the studs.

27. The apparatus of claim 24 in which the first and second fluid end bodies are in flush engagement with one another.

28. The apparatus of claim 24 in which the second fluid end body is flangeless.

29. The apparatus of claim 24 in which the first fluid end body is attached to the second fluid end body such that the back side of the first fluid end body aligns with and abuts the front side of the second fluid end body.

30. The apparatus of claim 24, in which the first fluid end body further comprises:

a discharge bore extending through the first fluid end body and intersecting the first bore; and in which fluid enters the first fluid end body through the opening of the first bore formed on the bottom end of the first fluid end body.

31. The apparatus of claim 24, further comprising:

an intake manifold attached to the bottom end of the first fluid end body.

32. The apparatus of claim 24, in which the first fluid end body is of single-piece construction and further comprises:

a discharge valve installed within the first bore.

33. The apparatus of claim 24, in which the first fluid end body further comprises:

an intake valve installed within the first bore; and a discharge valve installed within the first bore.

34. The apparatus of claim 33, in which the intake valve and the discharge valve are removable from the first fluid end body without detaching the first fluid end body from the second fluid end body.

35. The apparatus of claim 24, further comprising:

a stuffing box disposed at least partially within both the first fluid end body and the second fluid end body; and a plunger disposed within the stuffing box.

36. The apparatus of claim 24, in which at least two of the counterbores overlap one another.

37. An apparatus, comprising:

a first fluid end body, comprising:

an external surface having a front side and an opposed back side and opposed top and bottom ends; and at least one bore pair, comprising:

a first bore extending through the first fluid end body and terminating at openings formed in the top and bottom ends;

the first bore configured to receive an intake valve and a discharge valve; and a second bore extending through the first fluid end body, intersecting the first bore, and terminating at openings formed in the front and back sides; the second bore configured to receive at least a portion of a plunger; and a second, flangeless fluid end body, formed as a different piece from the first fluid end body, and comprising:

an external surface having a front side and an opposed back side;

at least one bore extending through the second fluid end body and terminating at an opening formed in the external surface, the opening alignable with a corresponding opening formed in the back side of the first fluid end body; and a plurality of passages extending through the second fluid end body, each of the plurality of passages opening on the back side of the second fluid end body and opening into one of a plurality of counterbores on the front side of the second fluid end body, each passage of the plurality of passages configured to receive one of a plurality of stay rods such that an end of each stay rod is situated within a corresponding one of the plurality of counterbores;

in which the plurality of stay rods are configured to releasably attach the second fluid end body to a power end such that the second fluid end body and the power end are in a spaced relationship;

wherein the first and second fluid end bodies are attached such that the front side of the second fluid end body engages the back side of the first fluid end body; and in which the end of each of the plurality of stay rods is configured to receive a threaded nut such that one or more threaded nuts are enclosed within each of the plurality of counterbores when the back side of the first fluid end body is held against the front side of the second fluid end body.

38. The apparatus of claim 37 further comprising:

a first fastening system attaching the first fluid end body to the second fluid end body.

39. The apparatus of claim 38 in which the fastening system comprises:

a plurality of externally threaded studs supported by the first fluid end body and projecting from the back side of the first fluid end body;

a plurality of fastener openings formed about the periphery of the second fluid end body, each fastener opening registerable with a corresponding one of the studs; and a plurality of internally threaded nuts installed on a corresponding one of the studs.

40. The apparatus of claim 39, in which the first fluid end body and the second fluid end body are in a spaced relationship prior to attaching the bodies using the first fastening system.

41. The apparatus of claim 37 in which the first and second fluid end bodies are flushly engaged.

42. The apparatus of claim 41 wherein the surface dimensions of the front side of the second fluid end body and the back side of the first fluid end body are the same.

43. The apparatus of claim 37 in which the first and second fluid end bodies are engaged via one or more spacer elements.

44. The apparatus of claim 37 in which the first and second fluid end bodies have the same depth and height.

45. The apparatus of claim 44 in which the first fluid end body has a greater thickness than the second fluid end body.

46. The apparatus of claim 45 in which the first fluid end body is made from a stronger material than the second fluid end body.

47. The apparatus of claim 37, in which the first fluid end body further comprises:

a discharge bore extending through the first fluid end body and intersecting the first bore; and in which fluid enters the first fluid end body through the opening of the first bore formed on the bottom end of the first fluid end body.

48. The apparatus of claim 37, further comprising:

an intake manifold attached to the bottom end of the first fluid end body.

49. The apparatus of claim 37, in which the first fluid end body is of single-piece construction and further comprises:

a discharge valve installed within the first bore.

50. The apparatus of claim 37, in which the first fluid end body further comprises:

an intake valve installed within the first bore; and a discharge valve installed within the first bore.

51. The apparatus of claim 37, further comprising:

a stuffing box disposed at least partially within both the first fluid end body and the second fluid end body; and a plunger disposed within the stuffing box.

52. The apparatus of claim 37, in which at least two of the counterbores overlap one another.

* * * * *